US010995965B2

(12) United States Patent
Maricic et al.

(10) Patent No.: US 10,995,965 B2
(45) Date of Patent: May 4, 2021

(54) ULTRA-LOW $NO_x$ BURNER

(71) Applicant: BECKETT GAS, INC., North Ridgeville, OH (US)

(72) Inventors: Richard Maricic, Parma, OH (US); Rupesh Savadekar, Rocky River, OH (US); Michael J. O'Donnell, Avon, OH (US)

(73) Assignee: BECKETT GAS, INC., North Ridgeville, OH (US)

( * ) Notice: Subject to any disclaimer, the term of this patent is extended or adjusted under 35 U.S.C. 154(b) by 273 days.

(21) Appl. No.: 14/763,362

(22) PCT Filed: Jan. 24, 2014

(86) PCT No.: PCT/US2014/012979

§ 371 (c)(1),
(2) Date: Jul. 24, 2015

(87) PCT Pub. No.: WO2014/116970

PCT Pub. Date: Jul. 31, 2014

(65) Prior Publication Data

US 2015/0369495 A1 Dec. 24, 2015

Related U.S. Application Data

(60) Provisional application No. 61/756,704, filed on Jan. 25, 2013, provisional application No. 61/877,600, filed on Sep. 13, 2013.

(51) Int. Cl.
*F24D 19/10* (2006.01)
*F23D 14/04* (2006.01)
(Continued)

(52) U.S. Cl.
CPC ..... *F24D 19/1084* (2013.01); *F23D 14/045* (2013.01); *F23D 14/58* (2013.01);
(Continued)

(58) Field of Classification Search
CPC ..... F23D 14/586; F23D 14/14; F23D 14/58; F23D 14/045; F23D 23/00; F23D 14/02; F24D 19/1084
See application file for complete search history.

(56) References Cited

U.S. PATENT DOCUMENTS 3,857,670 A * 12/1974 Karlovetz ..... D06F 67/02 431/329
4,285,666 A * 8/1981 Burton ..... F23C 13/00 431/329

(Continued)

FOREIGN PATENT DOCUMENTS

GB 191419073 A * 7/1915 ..... F23D 14/58
JP 58127011 A * 7/1983 ..... F23D 14/18

OTHER PUBLICATIONS

EP 14743691.9 Supplementary Partial European Search Report completed Jul. 29, 2016.

(Continued)

*Primary Examiner* — Jason Lau
(74) *Attorney, Agent, or Firm* — Tarolli, Sundheim, Covell & Tummino LLP

(57) ABSTRACT

A burner for use with an igniter for firing a flame into a heat-exchanger includes a body having a sidewall that defines an interior chamber. A first opening in the body receives a pre-mixed mixture of air and fuel. A second opening in the body is in fluid communication with the first opening. A distributor connected to the body closes the second opening. The distributor includes a first portion and at least one curved second, portion provided on the first portion. Each second portion includes a plurality of first perforations in fluid communication with the first opening in the body. The first perforations of one second portion are positioned adjacent to the igniter such that ignition of the
(Continued)

pre-mix mixture flowing through the first perforations results in a flame through the second portion.

25 Claims, 22 Drawing Sheets

(51) Int. Cl.
*F23D 14/58* (2006.01)
*F23D 23/00* (2006.01)
*F24H 3/06* (2006.01)
*F24H 8/00* (2006.01)

(52) U.S. Cl.
CPC ..... *F23D 23/00* (2013.01); *F24H 3/06* (2013.01); *F24H 8/00* (2013.01); *F23D 2203/105* (2013.01); *F23D 2203/1017* (2013.01); *F23D 2207/00* (2013.01); *F23D 2212/103* (2013.01); *F23D 2212/201* (2013.01)

(56) References Cited

U.S. PATENT DOCUMENTS 4,799,879 A * 1/1989 Laspeyres ..... F23D 14/14 431/328
5,417,199 A * 5/1995 Jamieson ..... F24H 3/087 126/110 AA
5,711,661 A * 1/1998 Kushch ..... F23D 14/12 431/326
5,899,686 A 5/1999 Carbone et al.
6,004,129 A * 12/1999 Carbone ..... F23D 14/02 431/326
2004/0253559 A1 12/2004 Schultz et al.
2006/0292510 A1* 12/2006 Krauklis ..... F23D 14/145 431/326
2009/0325114 A1* 12/2009 Noman ..... F23C 6/02 431/354
2010/0291495 A1* 11/2010 Scribano ..... F23D 14/105 431/174
2010/0310998 A1 12/2010 Raleigh et al.
2012/0247444 A1 10/2012 Sherrow et al.

OTHER PUBLICATIONS

PCT/US2014/012979 International Search Report and Written Opinion, completed Jul. 2, 2014.

* cited by examiner

ULTRA-LOW $NO_x$ BURNER

CROSS REFERENCES TO RELATED APPLICATIONS

This application filed under 35 U.S.C § 371 is a national phase application of International Application Serial Number PCT/US2014/012979 filed Jan. 24, 2014, which claims priority to U.S. Provisional Application 61/756,704, filed Jan. 25, 2013 and U.S. Provisional Application 61/877,600, filed Sep. 13, 2013.

TECHNICAL FIELD

The invention relates to burners for appliances such as furnaces and, in particular, relates to an ultra-low oxides of nitrogen ($NO_x$) burner that provides flame carryover to accommodate multiple heat exchanger tubes in residential and commercial gas-fired furnaces.

BACKGROUND

Recently, new $NO_x$ emission requirements for residential gas-fired central furnaces have been implemented in an effort to reduce the environmental impact of their use. A few types of burners used on different types of gas-fired appliances are capable of meeting the specified $NO_x$ level. None, however, have been successfully applied to a residential gas-fired furnace of the type to which this invention pertains, for several reasons. In particular, the current burners are designed to fire into a single heat exchange chamber. Current residential furnace designs, however, have heat exchangers made with multiple tubes, clamshell or drum sections with separate burners firing into each tube or section. The cost of applying current single burner technologies to multiple section heat exchangers would be prohibitively expensive due to the cost of requiring multiple burners There is also a problem with flame carryover from one burner to the next. Current furnace inshot burners have wings with channels to accomplish this. For this to be accomplished with current ultra-low $NO_x$ burners, however, a significantly more costly and complex design would be required. Moreover, since space is very limited in the compartment where the burners are installed more space would be required than is currently available in order to satisfy the above emission requirements.

The most common way of producing $NO_x$ is the thermal $NO_x$ pathway. As the temperature of the reaction increases, so does the $NO_x$ level. Also, $NO_x$ formation is relatively slow compared to other combustion reactions. Therefore, if the flame temperature and/or if the reaction time can be reduced $NO_x$ levels can be controlled. Accordingly, there is a need for a burner for residential gas-fired furnaces that can be controlled to produce $NO_x$ emission levels that comply with appliance regulations.

SUMMARY OF THE INVENTION

In accordance with the present invention a burner for use with an igniter for firing a flame into a heat-exchanger includes a body having a sidewall that defines an interior chamber. A first opening in the body receives a pre-mixed mixture of air and fuel. A second opening in the body is in fluid communication with the first opening. A distributor connected to the body closes the second opening. The distributor includes a first portion and at least one curved second portion provided on the first portion. Each second portion includes a plurality of first perforations in fluid communication with the first opening in the body. The first perforations of one second portion are positioned adjacent to the igniter such that ignition of the pre-mix mixture flowing through the first perforations results in a flame through the second portion.

In another aspect of the present invention, a furnace for heating a space, such as the interior of a home or business, includes a burner assembly for use with an igniter. The burner assembly includes a body having a sidewall that defines an interior chamber for receiving a pre-mixed mixture of air and fuel. A distributor connected to the body closes the interior chamber. The distributor includes a first portion and a plurality of curved second portions provided on the first portion. Each second portion includes a plurality of first perforations in fluid communication with the interior chamber. The second portions are fluidly connected to one another by a plurality of second perforations formed in the first portion. The first perforations of one of the second portions are positioned adjacent to the igniter such that ignition of the pre-mix mixture flowing through the first perforations results in a flame at each of the second portions. In one preferred and illustrated embodiment, a primary heat exchanger is provided and includes a plurality of tubes associated with the second portions of the distributor such that the flame from each second portion supplies heat to each associated tube. In this embodiment, the primary heat exchanger is located within a heat exchange chamber that is at least partially defined by a furnace cabinet. In the illustrated embodiment, the cabinet also includes a blower for blowing comfort air through the heat exchange chamber where it is heated by the primary heat exchanger and then distributed in a known way, to the heated space of a home or business. In this preferred and illustrated embodiment, a secondary heat exchanger or "condensing" heat exchanger is located between the primary heat exchanger and blower and may also be mounted in the heat exchange chamber. The condensing heat exchanger receives products of combustion from the primary heat exchanger and extracts further heat from these products. In this embodiment, the comfort air provided by the blower flows first through the condensing heat exchanger and then past the primary heat exchanger. It should be noted here that present invention should not be limited to a condensing type heating apparatus and may be used in furnaces of the type that have a single heat exchanger located in a heat exchange chamber. The invention also contemplates using both tube type heat exchangers as well as clamshell heat exchangers.

In another aspect of the present invention, an apparatus is provided for a furnace for heating a space, such as an interior of a home or business. The furnace has a vestibule chamber and a heat exchange chamber, the vestibule chamber containing a burner assembly for receiving a pre-mix mixture of air and gas and igniting the pre-mixture to produce a plurality of flames. The burner assembly further includes an igniter and a flame proving sensor. The heat exchange chamber contains a primary heat exchanger having a plurality of tubes associated with the burner assembly such that the flames from the burner assembly supply heat to each tube. The heat exchange chamber further contains a blower for blowing air over the plurality of tubes to heat the air and provide heat to the space. The apparatus includes a vest panel positioned within the furnace for delimiting the heat exchange chamber and the vestibule chamber. The vest panel has a notch that defines a passage within the vestibule along the burner assembly for accessing the igniter and flame proving sensor. In another aspect of the present invention, a distributor is provided for a burner assembly used with an igniter and having a body defining an interior chamber for receiving a pre-mixed mixture of air and fuel. The distributor closes the interior chamber and includes a first portion and at least one curved second portion provided on the first portion. Each second portion includes a plurality of first perforations in fluid communication with the interior chamber. The first perforations of one second portion are positioned adjacent to the igniter such that ignition of the pre-mix mixture flowing through the first perforations results in a flame through the second portion.

According to one illustrated embodiment of the invention, a pre-mix burner is disclosed for use in a furnace or the like. The burner comprises a burner body having an inlet for receiving combustion air. A burner opening is preferably defined by the body and mounts a distributor plate that covers at least a portion of the burner opening and defines at least one concave or convex dimple and a substantially planar portion that surrounds the dimple. The pre-mix burner may include a dimple that has both concave and convex portions. The dimple includes a plurality of perforations for allowing a fuel or gas/air mixture to pass through the distributor and to be combusted in a combustion chamber. The dimple perforations operate to control the flow of gas/air mixture in order to focus a resulting flame during combustion of the gas/air mixture. A metal fiber mesh, such as FeCrAlM overlies the distributor and defines a burner surface where combustion of the fuel/air mixture occurs. Preferably, the metal fiber mesh includes at least one dimple portion which at least partially conforms to the dimple defined by the distributor.

According to a more preferred embodiment, the pre-mix burner includes a plurality of dimples, each surrounded by a planar portion. Flame carryover perforations are preferably formed in the planar portion in a region between the dimples. In one illustrated embodiment, the perforations in the dimple are configured such that a central portion of the dimple provides less restriction to flow of the fuel/air mixture as compared to an outer section of the dimple.

A heating apparatus for heating comfort air in order to heat an interior space of a structure is disclosed which incorporates the pre-mix burner of the present invention. The heating apparatus includes a cabinet that defines a vestibule chamber, a heat exchanger chamber and blower chamber. A heat exchanger is located within the heat exchange chamber and includes inlet structure that is aligned with burner dimples defined by the pre-mix burner. The inlet structure is operative to receive heat and combustion products from the pre-mix burner; the products of combustion travel through the heat exchanger and heat comfort air that is urged through the heat exchange chamber by the comfort air blower. A draft blower also preferably forms part of the furnace and urges the fuel/air mixture through the burner and the heat exchanger; the dimples are operative to focus the fuel/air mixture towards the inlet structure of the heat exchanger.

According to a further aspect of this embodiment, the comfort air blower introduces comfort air to be heated through an opening in the heat exchange chamber that is located near the inlet structure of the heat exchanger. In one illustrated embodiment, the heat exchanger comprises a tubular heat exchanger that comprises a plurality of tubes, each having a tube inlet located in alignment with an associate dimple defined by the distributor. The invention, however, contemplates use of a clamshell type heat exchanger known in the art.

In one illustrated embodiment, the heating apparatus or furnace includes a vest panel that mounts the pre-mix burner. The pre-mix burner further includes a combustion chamber member attached to the burner body and located in the vestibule chamber such that combustion of the gas air mixture occurs at least partially upstream of the heat exchange chamber. In another illustrated embodiment, the heating apparatus includes a vest panel that defines a recess or notch for providing access, from the vestibule chamber, to an igniter and/or a flame sensor that is located in the combustion chamber.

In the illustrated embodiment, the heating apparatus also includes a mixer for mixing gas and combustion air prior to introduction into the burner body.

In the illustrated embodiment the above described heat exchange is a primary heat exchanger and the heating apparatus further includes a secondary heat exchanger located intermediate the comfort air blower and the primary heat exchanger.

Other objects and advantages and a fuller understanding of the invention will be had from the following detailed description of the preferred embodiments and the accompanying drawings.

DETAILED DESCRIPTION

Figure 1:
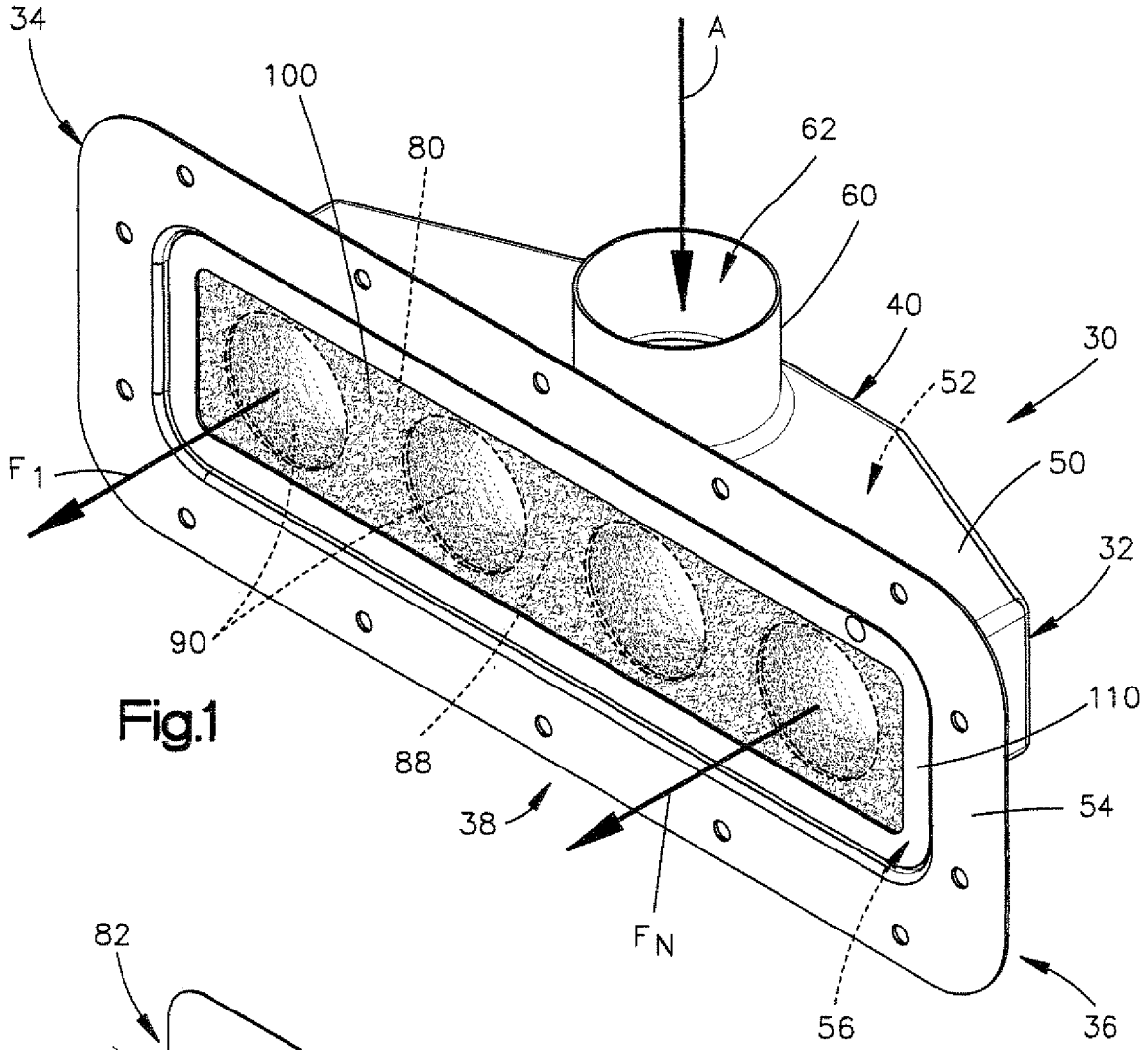
FIG. 1 is a front view of a burner in accordance with an embodiment of the present invention.
Figure 2A:
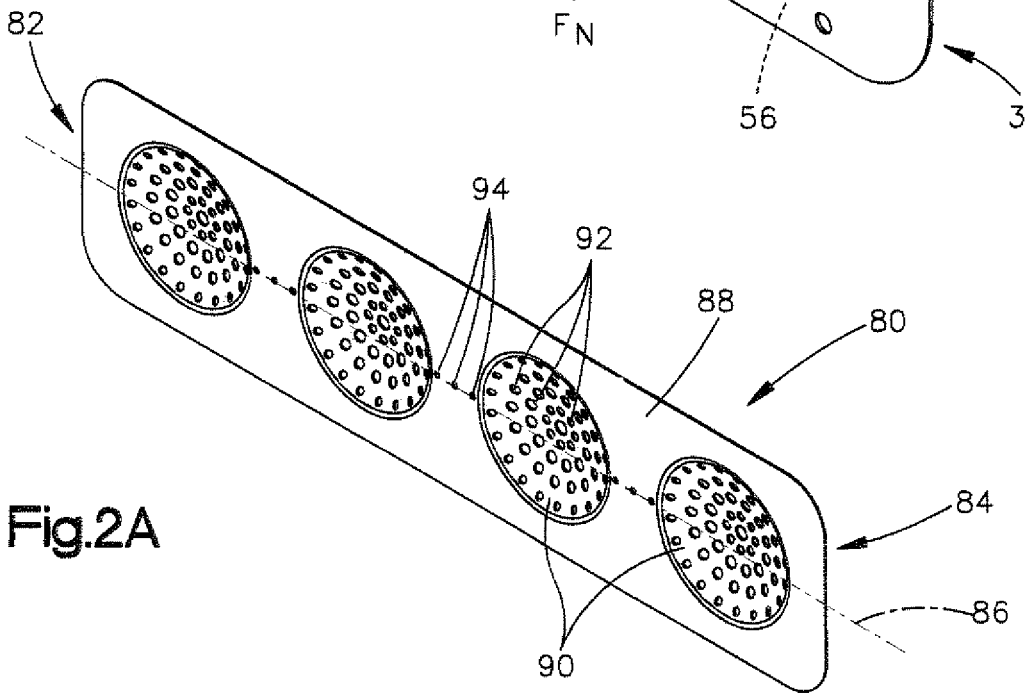
FIG. 2A is a front view of a distributor for producing multiple flame outputs for the burner of FIG. 1.
Figure 2C:
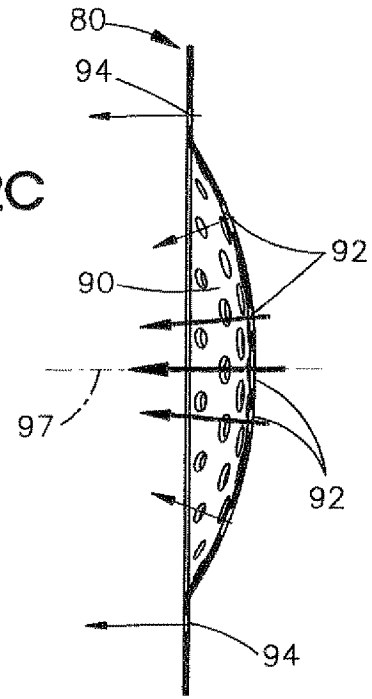
FIG. 2C is a sectional view of the distributor of FIG. 2B taken along line 2C-2C.

The invention relates to burners for appliances and, in particular, relates to an ultra-low-$NO_x$ burner that provides flame carryover to accommodate multiple heat exchanger sections in residential and commercial gas-fired furnaces. Alternative appliances in which the burner of the present invention may be used include, for example, water heaters and ovens. FIGS. 1-3 illustrate a burner 30 in accordance with an aspect of the present invention. The burner 30 has a generally rectangular shape and includes a body 32 that extends from a first end 34 to a second end 36. The body 32 is formed from a durable material such as metal and has a first or front side 38 and a second or rear side 40 opposite the front side. The body 32 is formed by a sidewall 50 that has an elongated shape such as, for example, rectangular or trapezoidal. The sidewall 50 defines an interior chamber 52 that receives a pre-mixed mixture of fuel and air which is used to output flames from the burner 30. In particular, an inlet conduit 60 in fluid communication with the interior chamber 52 extends from the sidewall 50 and includes an opening 62 connected to a fuel and air source (not shown) in order to supply the pre-mix mixture to the interior chamber.

A flange 54 extends from the sidewall 50 along the front side 38 of the body 32. The flange 54 has a rectangular shape and includes an opening 56 in fluid communication with the interior chamber 52. The opening 56 in the flange 54 receives a distributor 80 (FIG. 2A). The distributor 80 closes the opening 56 in the flange 54 and substantially seals the front side 38 of the body 32. A separate seal (not shown) may be provided to ensure a fluid-tight seal between the periphery of the flange 54 and the distributor 80. The distributor 80 has an elongated shape that mimics the shape of the opening 56 in the flange 54, e.g., rectangular. The distributor 80 extends along a centerline 86 from a first end 82 to a second end 84. When the distributor 80 is secured to the flange 54 (see FIG. 1) the first end 82 of the distributor is positioned at the first end 34 of the body 32 and the second end 84 of the flange is positioned at the second end 36 of the body.

Referring to FIG. 2A, the distributor 80 is formed from a thin, durable, and heat-resistant material such as metal, metal screen or expanded metal. The distributor 80 includes a first portion 88 and at least one dimple or second portion 90 formed or provided on the first portion. The number, size, and spacing of the second portions 90 coincides with the number, size, and spacing of downstream heat exchanger sections (not shown) used in the furnace in which the burner 30 is used. In particular, each second portion 90 is aligned with an open end of an associated heat exchanger section such that the end of each section is in fluid communication with each second portion. Each second portion 90 is configured to provide a desired flame characteristic or profile from the burner 30 to the respective heat exchanger section.

In one example, the first portion 88 has a planar configuration and each second portion 90 is curved or dimple-shaped, e.g., rounded, concave or convex. Every second portion 90 may have the same configuration or different configurations from one another. A concave second portion 90 will provide a narrow, long or elongated flame while a convex second portion will provide a wider, more dispersed flame. Each second portion 90 may exhibit any circular or polygonal shape such as triangular, square or the like. As shown in FIG. 2A, four concave portions 90 are provided on a planar first portion 88 and each concave portion has the same generally circular or hemispherical shape. The planar portion 88 extends substantially along the centerline 86. Each concave portion 90 extends transverse, e.g., generally perpendicular, to the centerline 86 of the planar portion 88 towards the rear side 40 of the body 32. The concave portions 90 may all extend in the same direction of may extend in different directions relative to one another.

A series of perforations 92 formed in each concave portion 90 extends entirely through the material of the distributor 80. The perforations 92 may exhibit any shape, e.g., circular, square, triangular, etc., and may be randomly spaced about the concave portion 90 or may have predetermined spacing. As shown in FIG. 2A, each concave portion 90 has substantially the same perforation 92 configuration. The perforations 92 cooperate with the concave portions 90 to produce an elongated flame for each concave portion that extends into the corresponding heat exchanger section (not shown) during use of the burner 30. In accordance with the present invention, the perforations 92 and/or concave portions 90 may be individually or collectively tailored to provide a series of flames that have particular positions, sizes, and shapes.

A series of carryover perforations 94 may also extend through the planar portion 88 of the distributor 80. The carryover perforations 94 may be similar, identical or different than the perforations 92 in the concave portions 90. As shown in FIG. 2A, the carryover perforations 94 constitute one row of three perforations connecting each of the four concave portions 90 in succession and extending substantially along and parallel to the centerline 86. The carryover perforations 94 cooperate with the perforations 92 to provide a flame path between adjacent concave portions 90. The path allows a flame initiated at one concave portion 90 to propagate to all the concave portions 90 in the distributor 80. It will be appreciated that the carryover perforations 94 may be omitted between some of the concave portions 90 or omitted entirely.

Figure 2B:
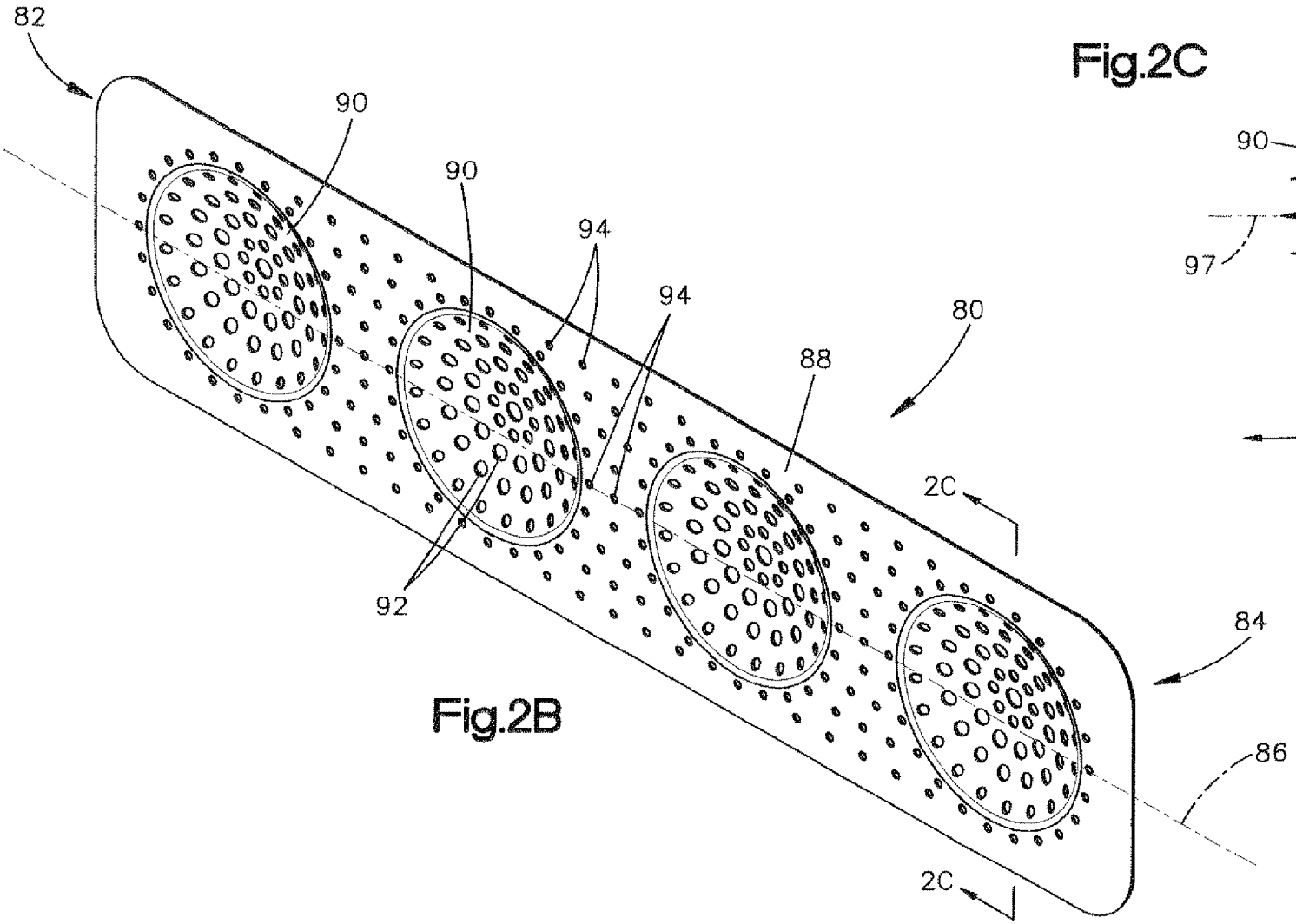
FIG. 2B is a front view of another example of a distributor for producing multiple flame outputs for the burner of FIG. 1.
Figure 3:
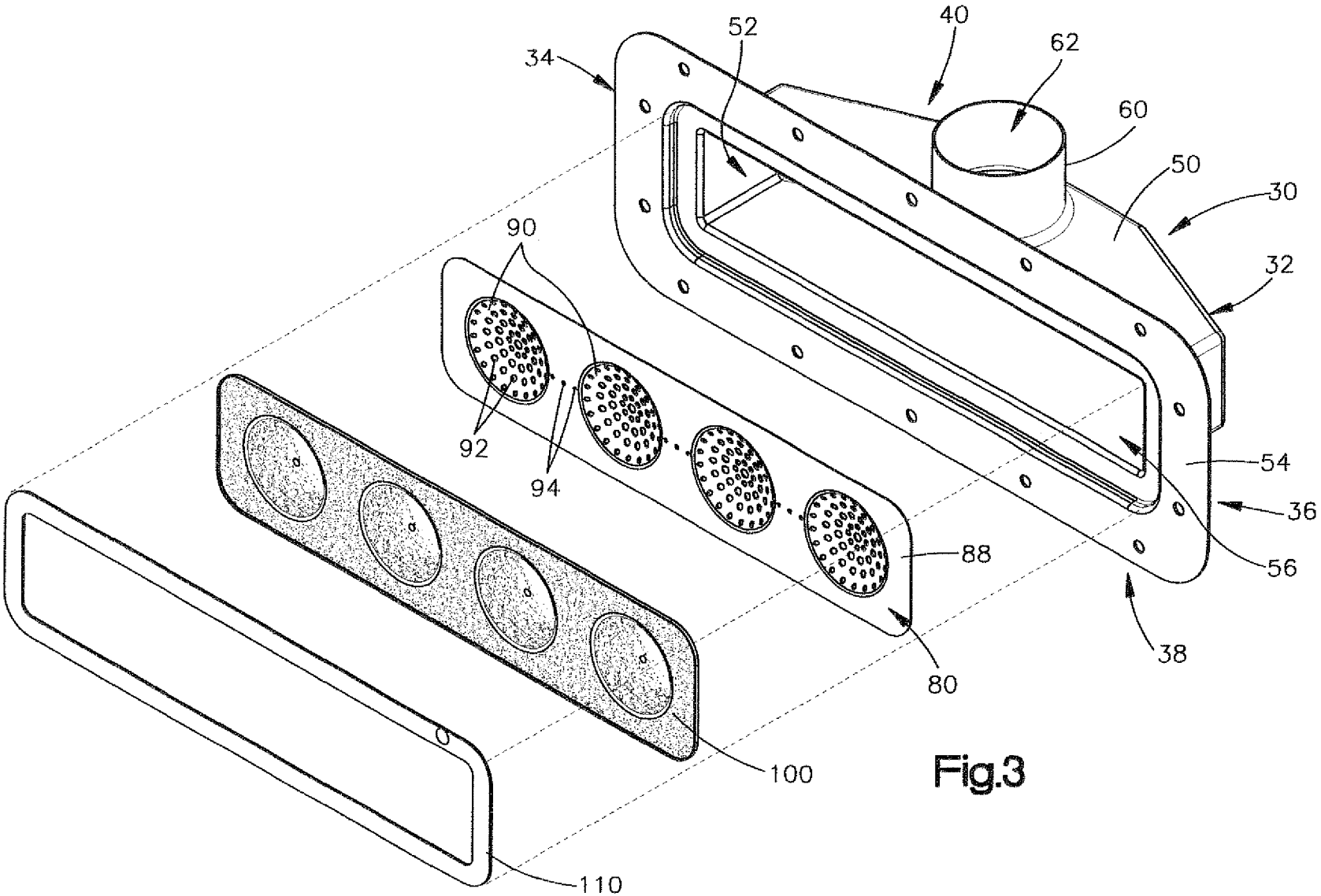
FIG. 3 is an exploded view of the burner of FIG. 1.

FIG. 2B illustrates an alternative embodiment for the distributor 80. As shown in FIG. 2B, the carryover perforations 94 are not only provided between the concave portions 90 but are also part of a series of perforations around the concave portions. The perforations 94 may occupy a significant amount of the planar portion 88 and may encircle or surround one or more of the concave portions 90. The additional perforations 94 create a short flame along or over the entire surface of the planar portion 88, which helps to reduce the pressure drop across the distributor 80 attributable to the pre-mix mixture passing therethrough.

As shown in FIG. 2C, an axis 97 extends perpendicular to the planar portion 88 and through the center of a concave portion 90. The perforations 94 extend substantially parallel to the axis 97 and the perforations 92 are angled towards the axis 97. Consequently, flow through the perforations 92 of each concave portion 90 is directed towards a common point along the axis 97 that coincides with the center of that curved portion. This helps to focus the flame produced therefrom along the axis 97 towards the center of the respective heat exchanger section (not shown). Flow through the perforations 94, however, is directed in a direction substantially parallel to the axis 97.

Alternatively or additionally, the first perforations 92 may have different sizes within the same concave portion 90. For example, the size of the first perforations 92 may increase in a direction extending towards the center of the concave portion 90 to maximize the flow area through the middle of the concave portion. Accordingly, the largest first perforation 92 may be located near or at the center of the concave portion 90. Consequently, the flame provided by that concave portion 90 is substantially aligned with the center of the respective heat exchanger section. In other words, the flame is concentrated at the center of the concave portion 90—where the largest flow area is located—and is minimized around the periphery of the concave portion—where the smallest flow area is located.

As shown in FIG. 3, a fiber mesh burner surface 100 overlies the distributor 80 and is formed from a material such as an iron-chromium alloy, e.g., FeCrAlM. The fiber mesh burner surface 100 is porous and may constitute a moldable metal fabric, foamed metal, formed perforated ceramic or the like. The material of the fiber mesh burner surface 100 can be selected to promote desired flame characteristics. The burner surface 100 is contoured to match the contour of the distributor 80 and, thus, the burner surface includes the same dimples or rounded portion(s) as the distributor. A cover retainer 110 is secured to the flange 54 of the body 32 to secure the fiber mesh burner surface 100 and distributor 80 between the body and the cover retainer.

In operation, and referring to FIG. 1, a pre-mix mixture of air and fuel is supplied via a duct or the like (not shown) to the opening 62 of the inlet conduit 60 in the manner indicated generally by the arrow A. The pre-mix mixture flows through the interior chamber 52 and towards the opening 56 in the flange 54, i.e., from the rear side 40 of the body 32 to the front side 38. The pre-mix mixture then flows through the distributor 80 and, more specifically, flows through the perforations 92, 94 in both the concave portions 90 and the planar portion 88 of the distributor. An igniter (not shown) positioned adjacent to the leftmost concave portion 90 (as viewed in FIG. 1) ignites the pre-mix mixture flowing through the leftmost concave portion. Alternatively, the igniter could be positioned adjacent to any other concave portion 90. In any case, when the igniter is activated, the air and fuel mixture is ignited to produce a flame, indicated generally by arrow $F_1$ in FIG. 1 that extends from the surface of the fiber mesh burner surface 100 outward away from, the burner 30. The flame $F_1$ has a desired size and shape based on the configuration of the concave portion 90 and associated perforations 92. The flame $F_1$ extends away from the concave portion 90 and into the associated heat exchanger section (not shown).

Since the carryover perforations 94 in the planar portion 88 fluidly connect adjacent concave portions 90, the flame $F_1$ in the leftmost concave portion carries over or propagates across the planar portion via the carryover perforations and ignites the pre-mix mixture flowing through the adjacent concave portion. The flame through this concave portion 90 likewise has a desired size and shape for the associated heat exchanger section (not shown). The flame propagation is repeated to each successive concave portion 90 via the corresponding carryover perforations 94 until a flame $F_n$ is produced in the rightmost concave portion of the distributor 80 (as viewed in FIG. 1), which directs the flame $F_n$ into the corresponding heat exchanger section in the furnace (not shown). A flame sensor (not shown) may be positioned adjacent to the rightmost concave portion 90 that produces the flame $F_n$ in order to provide proof of ignition and propagation. Due to the repeatability and simplicity of the carryover perforations 94, the distributor 80 of the present invention can be configured to provide a low-$NO_x$ flame to any number of similar or different heat exchanger sections in an efficient, reliable manner. Moreover, since all the concave portions 90 are fluidly connected via the carryover perforations 94, the igniter and flame sensor can be placed adjacent to any concave portion(s) and the low-$NO_x$ flame $F_1$ will reliably propagate to all other concave portions.

Figure 4:
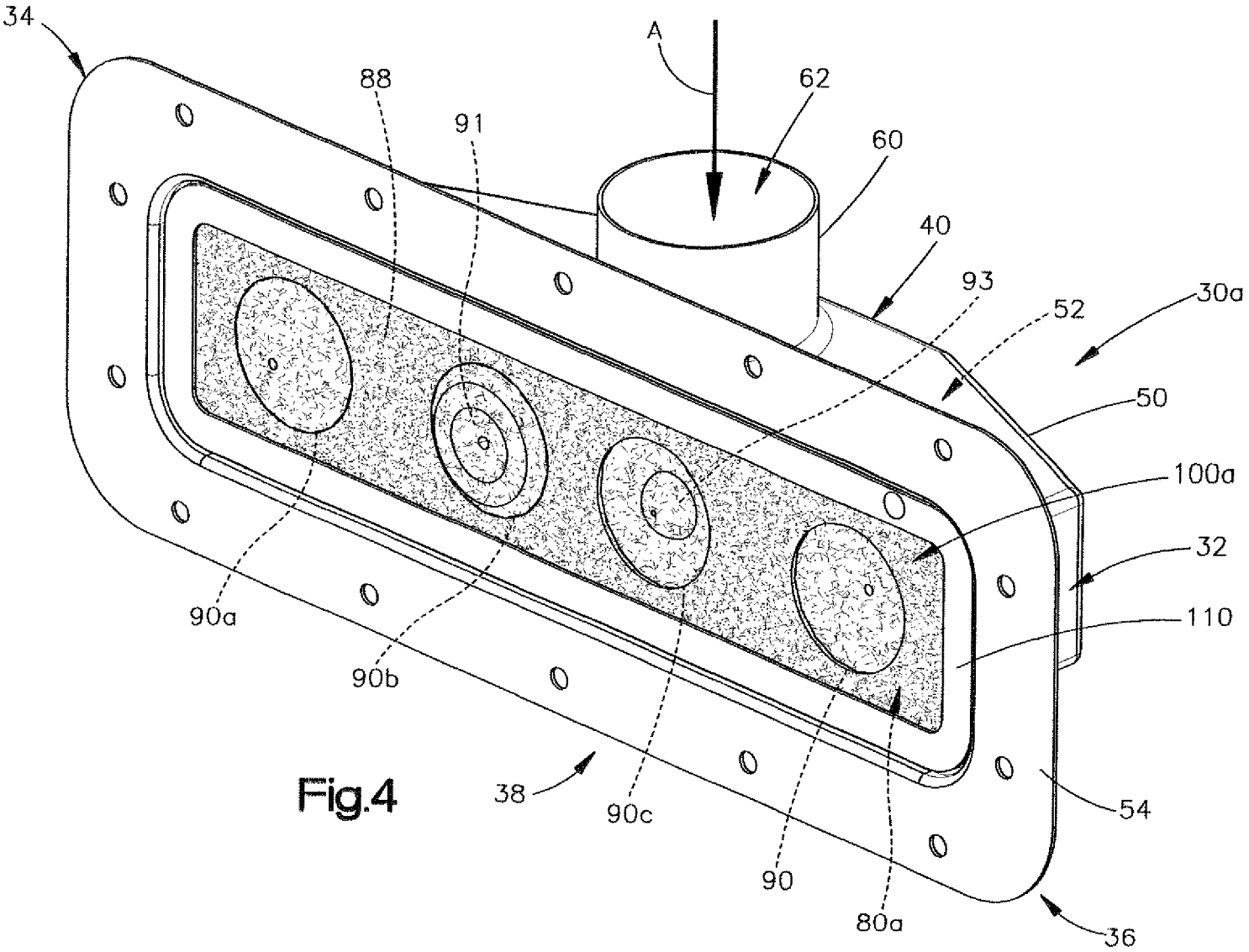
FIG. 4 is a schematic illustration of a burner in accordance with another aspect of the present invention.

FIG. 4 illustrates a burner 30*a* in accordance with another aspect of the present invention. In FIG. 4, features that are similar to those in FIGS. 1-3 have the same reference numeral whereas features that are different from those in FIGS. 1-3 are given the suffix "a", "b", etc. In FIG. 4, the distributor 80*a* and burner surface 100*a* have alternative configurations shown. In particular, FIG. 4 illustrates various configurations for the second portions 90*a-d* in the distributor 80 and burner surface 100*a*. As described, the second portion may be formed as the concave portion 90. Alternatively, the second portion may, for example, have a convex shape 90*a*, a convex shape 90*b* that includes a concave portion 91 or a concave shape 90*c* that includes a convex portion 93. The concave portion 91 may be located at the center of the convex shape 90*b* or may be spaced or offset therefrom. Similarly, the convex portion 93 may be located at the center of the concave shape 90*c* or may be spaced or offset therefrom. Regardless of the components 90*a*-90*d*, 91, 93, the second portion is configured to produce a particular flame profile, e.g., size and shape, for the heat exchanger section associated therewith. Although not illustrated, it will be appreciated that the distributor 80*a* includes the perforations 92 and carryover perforations 94 to tailor the position of each flame and match the contours of the burner surface 100*a* to provide flames to any number of heat exchanger sections while requiring ignition of only a single flame.

Figure 5:
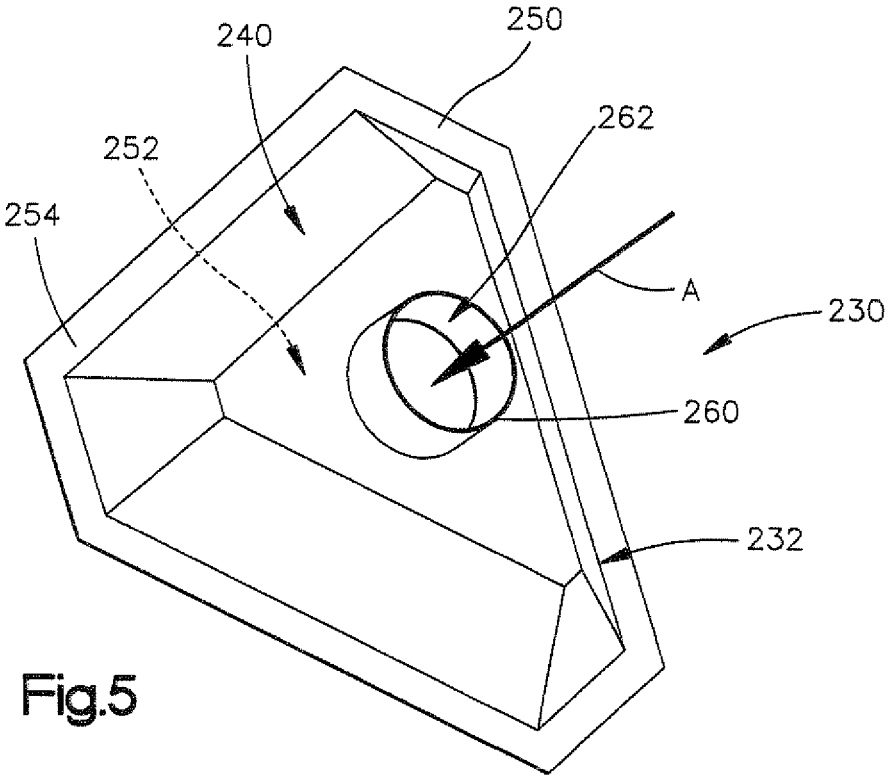
FIG. 5 is a rear view of a burner in accordance with another aspect of the present invention.
Figure 6:
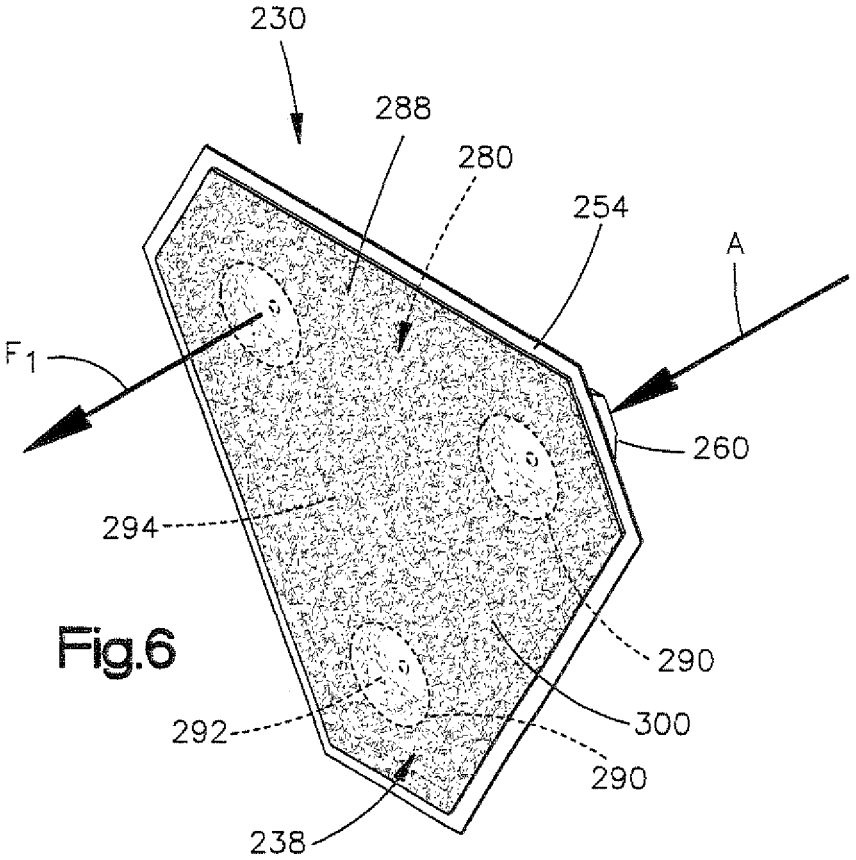
FIG. 6 is a front view of the burner of FIG. 5.

FIGS. 5-6 illustrate a burner 230 in accordance with another aspect of the present invention. In FIGS. 5-6, features that are similar to those in FIGS. 1-3 have a reference numeral that is 200 greater than the reference numerals in FIGS. 1-3. In FIGS. 5-6, the burner 230 includes a body 232 that has a substantially triangular sidewall 250 that defines an interior chamber 252 having a substantially pyramid or frustoconical shape. The inlet conduit 260 for the incoming pre-mix mixture A delivers the mixture to the center of the interior chamber 252. More specifically, the inlet conduit 260 extends through the rear side of the body 232 such that the pre-mix mixture A always flows in a direction towards the concave portion 290. Due to this construction, the pre-mix mixture A is fired more directly into the second portions 290 compared to the side-mounted inlet conduits.

Due to the triangular configuration of the sidewall 250 the flange 254, distributor 280, fiber mesh (not shown), and cover retainer (not shown) are likewise formed into substantially triangular shapes. In this example, the concave second portions 290 of the distributor 280 are equidistantly spaced about the periphery of the planar first portion 288 in a triangular pattern, although alternative spacing arrangements may be used with more or fewer second portions present. Furthermore, in contrast to the burner 30 of FIGS. 1-3 in which the flames $F_1$-$F_n$ extend perpendicular to the intake of the pre-mix mixture A the flames $F_1$-$F_n$ in the burner 230 extend parallel to the intake of the pre-mix mixture.

Similar to the burner 30 shown in FIG. 1, perforations 292 are formed in each concave portion 290 and perforations 294 are formed in the planar portion 288 to connect each concave portion together to allow for flame propagation from one of the concave portions to the remaining concave portions. The perforations 294 between concave portions 290 may form a triangular shape interconnecting all of the concave portions across the planar portion 288 or the perforations may form a "v-shape" connecting each concave portion.

Figure 7:
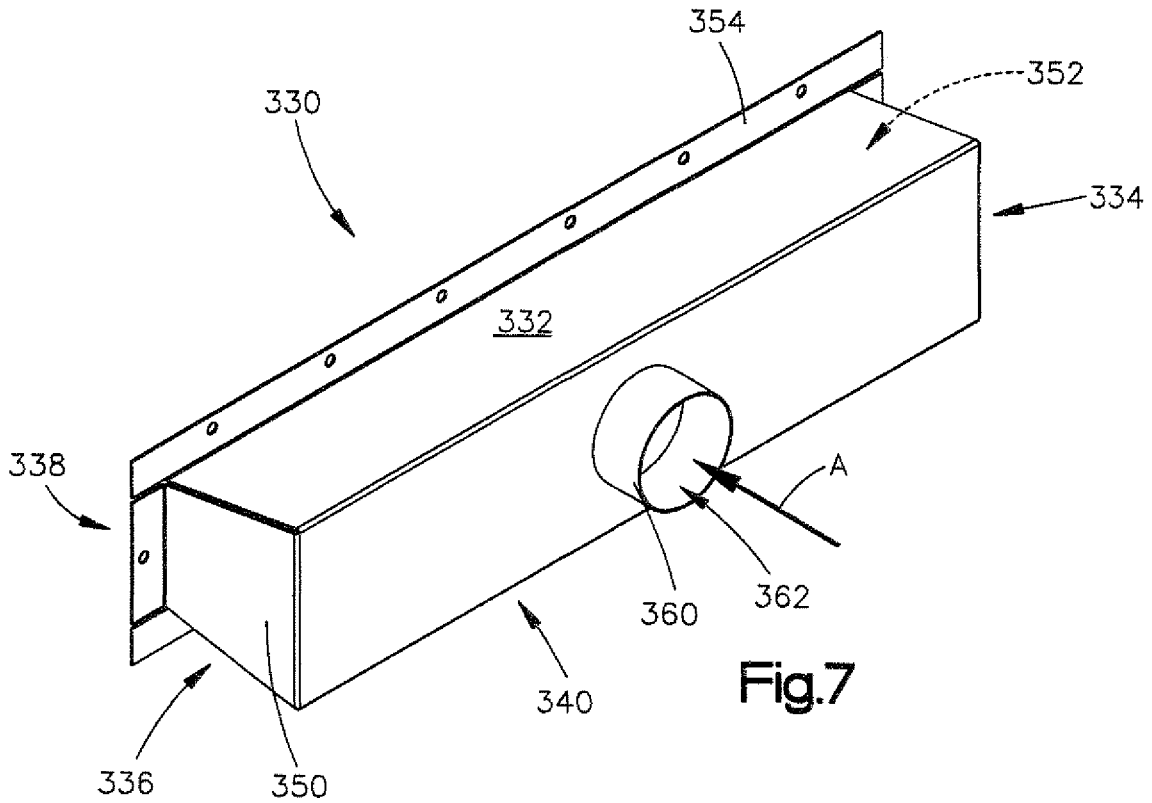
FIG. 7 is a side view of a burner in accordance with another aspect of the present invention.
Figure 8:
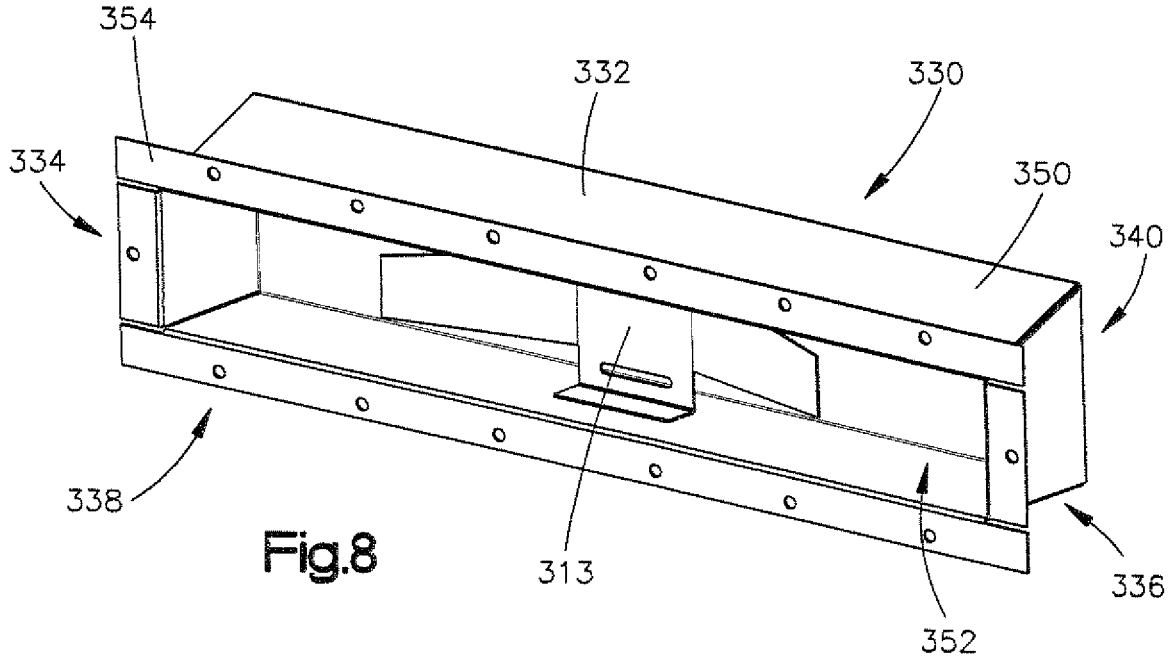
FIG. 8 is a sectional view of the burner of FIG. 7 taken along line 8-8.

FIGS. 7-8 illustrate a burner 330 in accordance with another aspect of the present invention. In FIGS. 7-8, features that are similar to those in FIGS. 1-3 have a reference numeral that is 300 greater than the reference numerals in FIGS. 1-3. In FIGS. 7-8, the burner 330 has a body 332 that tapers outwardly from the front side 338 to the rear side 340. The body 332 therefore has a trapezoidal or frustoconical cross-section. Furthermore, the inlet conduit 360 extends through the rear side 340 of the body 330 into the interior chamber 352. With this configuration, should a pressure pulse occur during operation or startup of the burner 330, it is relieved/damped by allowing the air and/or combustion products to expand within the outwardly tapering body 332. Additionally, one or more baffles 313 are provided in the interior chamber 352 to direct the incoming pre-mix mixture A to particular locations within the body 332, e.g., toward the first and second ends 334, 336 of the body.

Figure 9:
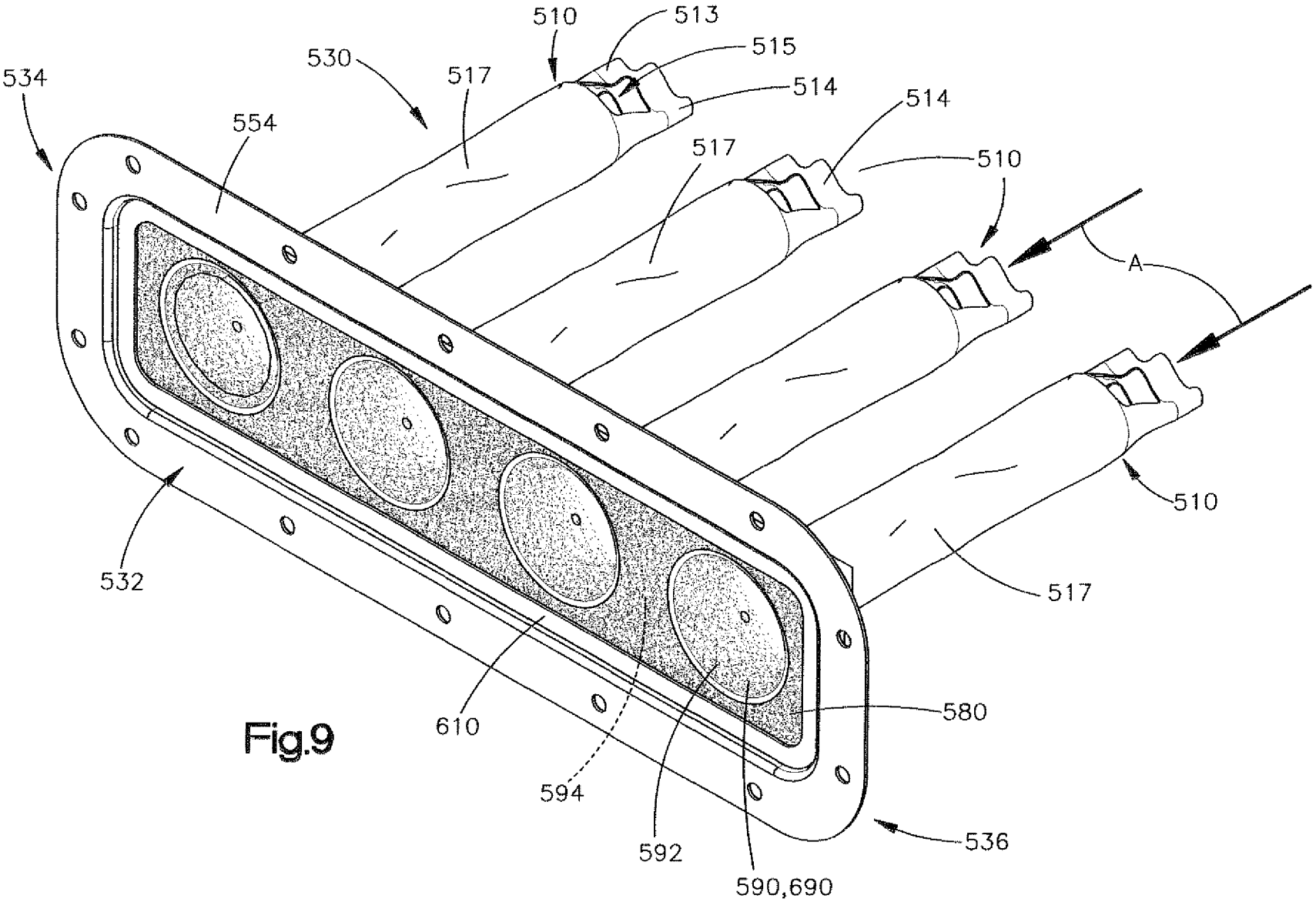
FIG. 9 is an illustration of a burner in accordance with another aspect of the present invention.
Figure 10:
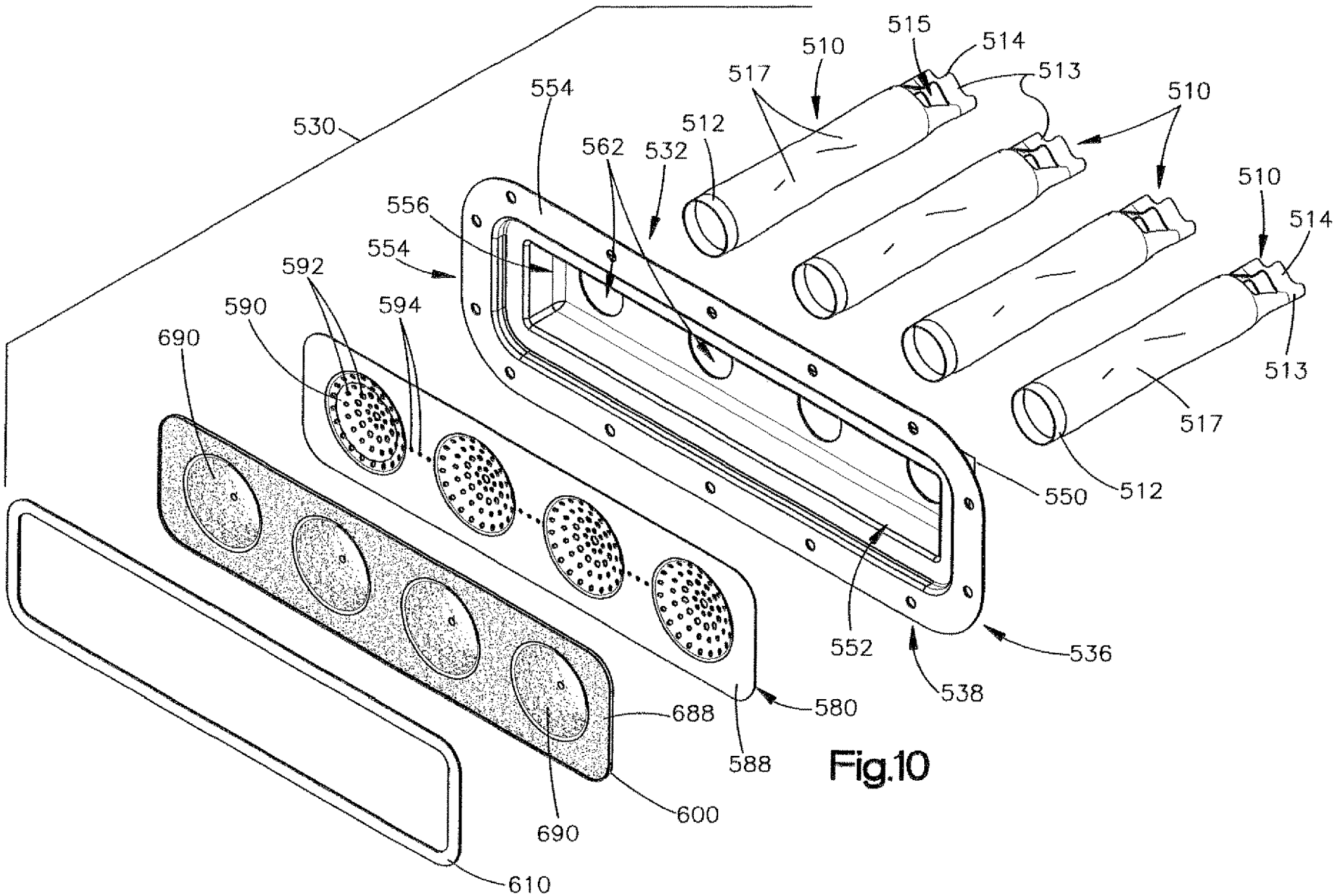
FIG. 10 is an exploded view of the burner of FIG. 9.

FIGS. 9-10 illustrate a burner 530 in accordance with another aspect of the present invention. In FIGS. 9-10, features that are similar to those in FIGS. 1-3 have a reference numeral that is 500 greater than the reference numerals in FIGS. 1-3. In FIGS. 9-10, the burner 530 is illustrated with a plurality of intake pipes 510 and, thus, the body 532 includes a plurality of corresponding openings 362 for receiving the intake pipes. The pipe 510 may constitute any intake pipe such as a pipe having a series of dimples 517 along its length to promote air and fuel mixing within the pipe. Each pipe 510 may constitute, for example, the pipe described in U.S. Pat. No. 6,916,174 or 6,371,753, the entirety of which are incorporated herein by reference. The dimples 517 may constitute, for example, the dimples described in U.S. Pat. No. 7,255,155 or U.S. Patent Publication No. 2008/0029243, the entirety of which is also incorporated by reference.

Referring to FIG. 10, each pipe 510 has a first end 512 positioned within one of the openings 562 of the body 532 for delivering a pre-mix mixture of air and gas to the interior chamber 552 and a second end 514 that receives the incoming gas and air mixture A. The second end 514 of each pipe 510 may have structure 513 for receiving a gas intake or orifice and one or more openings 515 for receiving air such that a pre-mix mixture A of air and gas is formed in the pipe 510 prior to reaching the body 530. Due to this construction, the pre-mix mixture A is fired more directly from each pipe 510 into each second portion 590.

The fiber mesh 600 exhibits substantially the same pattern as the distributor 580. More specifically, the fiber mesh 600 is formed with a first portion 688 and second portions 690 that exhibit the same shapes as the first portion 588 and second portions 590, respectively, of the distributor 580. The fiber mesh 600 may or may not be provided with perforations that mimic the perforations 592 and the carryover perforations 594.

Figure 11:
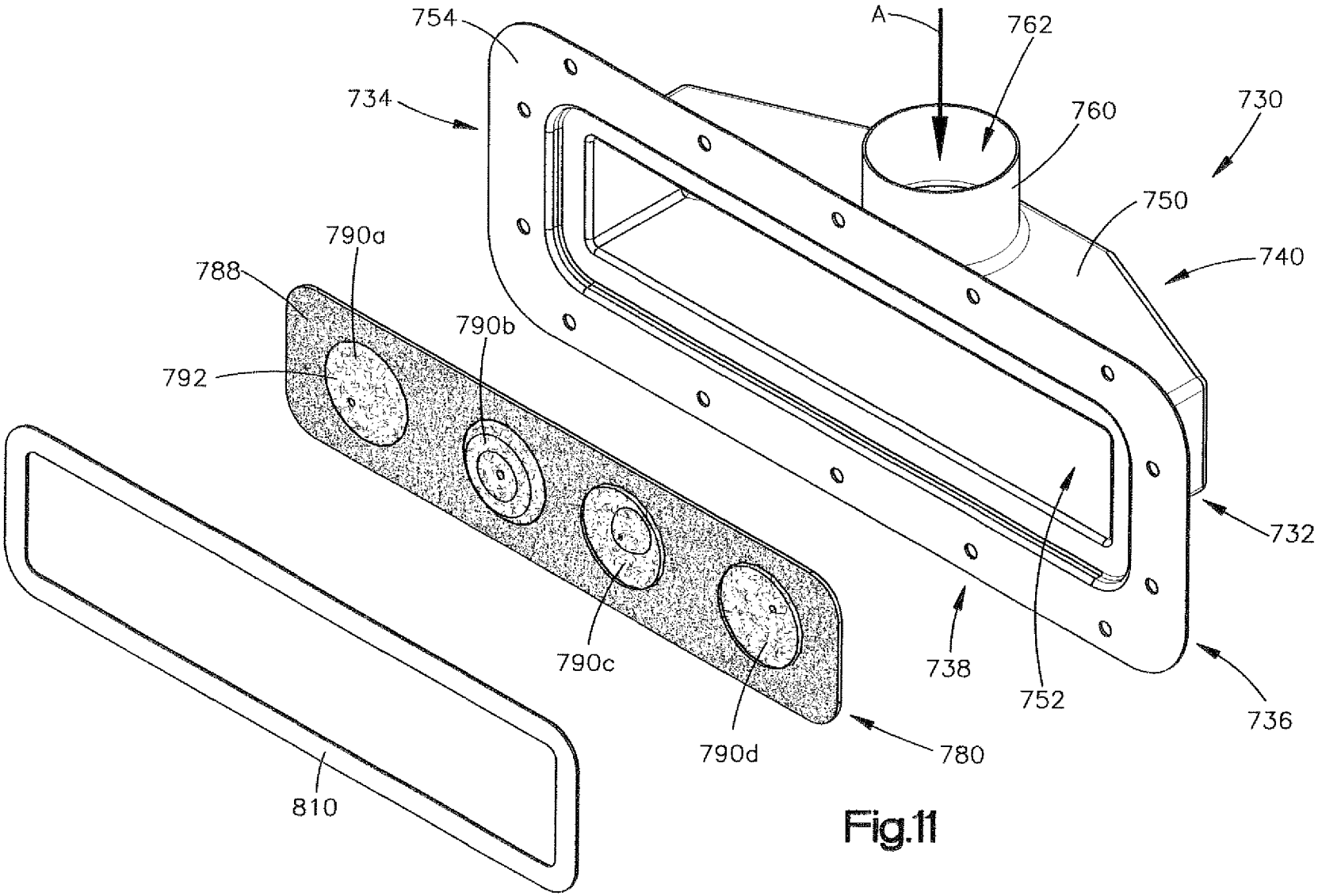
FIG. 11 is an illustration of a burner in accordance with another aspect of the present invention.

FIG. 11 illustrates a burner 730 in accordance with another aspect of the present invention. In FIG. 11, features that are similar to those in FIGS. 1-3 have a reference numeral that is 700 greater than the reference numerals in FIGS. 1-3. In FIG. 11, the fiber mesh burner surface and the distributor are formed as a one piece burner surface 780. The integral burner surface 780 may include any or all of the shapes 790*a-c* and/or portions 791, 793. Consequently, the integral burner 780 may also include the perforations 792, 794 (not shown). In one instance, the burner surface 780 is formed from a sintered FeCrAlM material having a perforated, foil-backed screen and is sufficiently rigid to hold its shape without the need for a more rigid support member, i.e., the distributor plate. Alternatively, the distributor burner surface 780 may be formed from ceramic, foamed metal, fiber mesh, foamed perforated ceramic or the like.

The burner of the present invention is advantageous in that it provides flames with low $NO_x$ emissions and can be tailored to meet a wide array of heating profiles. More specifically, each second portion and/or perforations formed thereon can be altered to produce different flames for different heat exchanger sections. This allows the same burner to be used in many different appliances or furnaces by simply replacing the distributor to provide the correct number, size, shape, and positioning of second portions and perforations for the corresponding heat exchanger sections.

The design of the distributor and, more specifically, of the perforations of the burner of the present invention is flexible to accommodate a wide array of appliances or furnaces. For example, 1) the Btu/hr per second portion can be varied by the size, geometry, and perforated substrate below the second portion, 2) the number of second portions can be varied to match the needs of the application, and 3) the second portions can have a variety of geometric shapes and sizes, e.g., concave, convex, varigated, etc. Furthermore, the second portions do not need to be linearly aligned and, thus, the second portions can be set-up in different geometric patterns to match the needs of the application, e.g., triangular, circular, S-pattern, etc.

In one preferred and illustrated embodiment, the burner of the present invention is 100% pre-mix and no secondary air is needed to complete combustion. By using this method, more precise control of the air-to-gas ratio can be achieved. In particular, increasing the air-to-gas ratio produces a lean flame that runs cooler than a rich frame, thereby lowering the $NO_x$ level. By providing a low $NO_x$ flame, the burner of the present invention exhibits a more even heat distribution and runs on a more lean mixture of air/gas, i.e., less gas. In order to meet the required Ng/j $NO_x$ levels, the flame can be leaned out to the point where it can become unstable and could blow off of the burner surface. The 100% pre-mixing, however, produces a homogenous mixture that is delivered to the mesh burner surface and has excellent flame retention properties.

It has been found that the burner of the present invention is capable of lowering $NO_x$ emission levels consistently below a level of about 14 Ng/j at an input rate of about 19,000 Btu per heat exchange section or tube. It will be appreciated, however, that the burner of the present invention may have an increased input rate, e.g., up to about 25,000-30,000 Btu per heat exchange section, for use in other applications such as commercial furnaces. The typical gas-fired residential furnace has a heat exchanger consisting of four serpentine 1.5 inch to 1.75 inch diameter tubes which is typical of current furnace designs. Other furnace designs, such as commercial applications, have or may have heat exchangers consisting of four serpentine 2.25 inch to 2.5 inch diameter tubes.

Figure 12A:
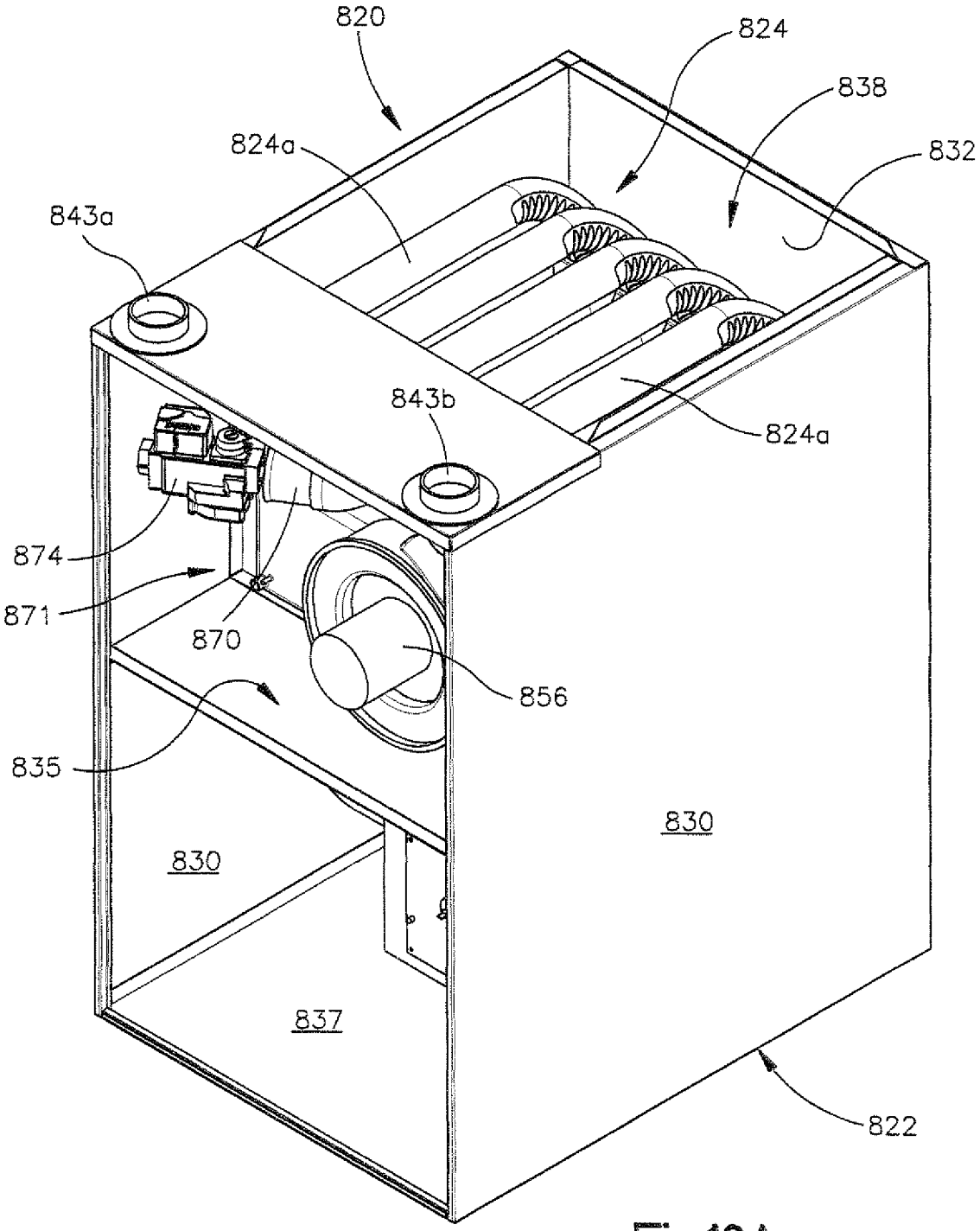
FIG. 12A is an isometric view of a furnace constructed in accordance with one embodiment of the invention.
Figure 12B:
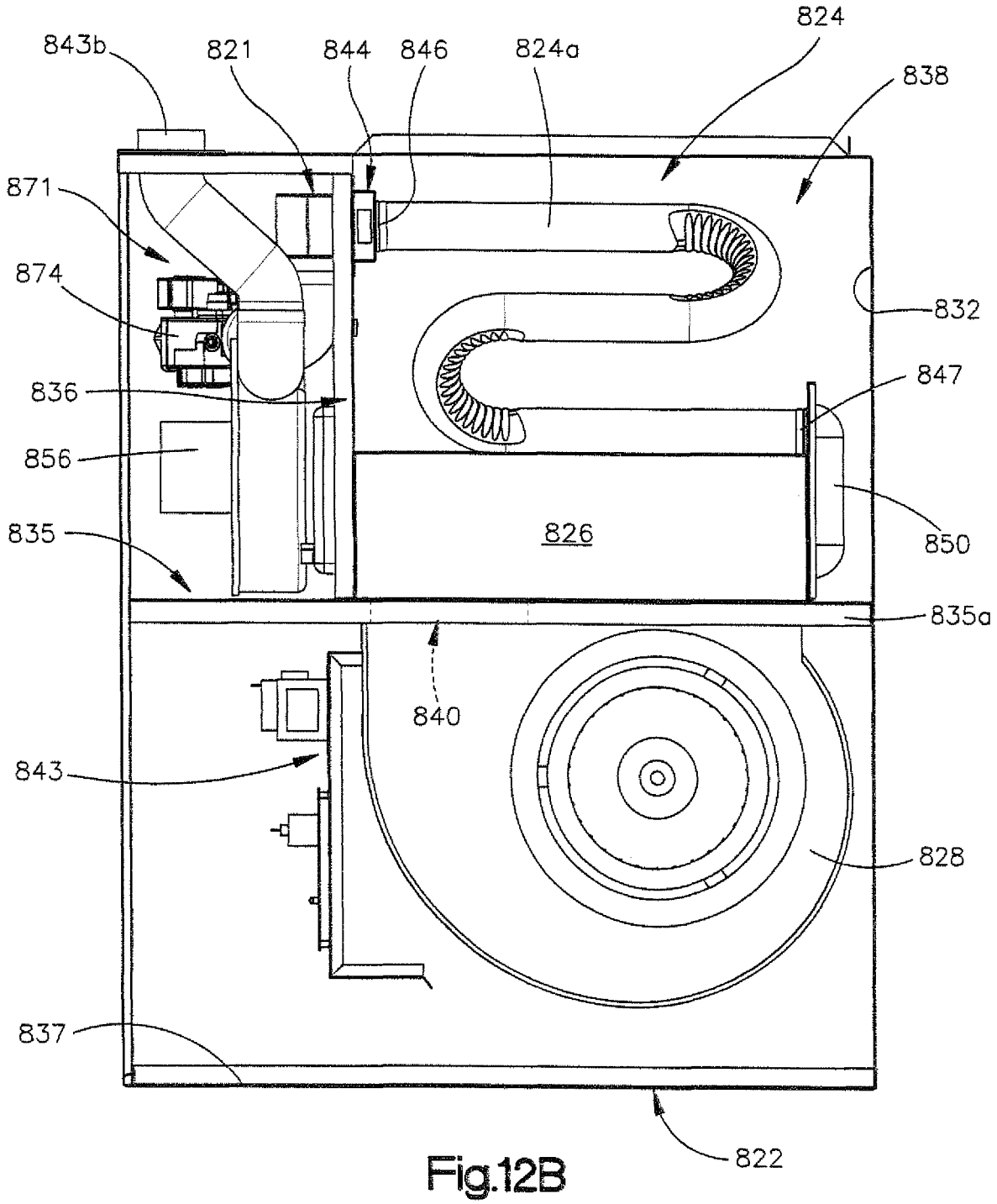
FIG. 12B is a side view of the furnace of FIG. 12A with the side panel removed.
Figure 13:
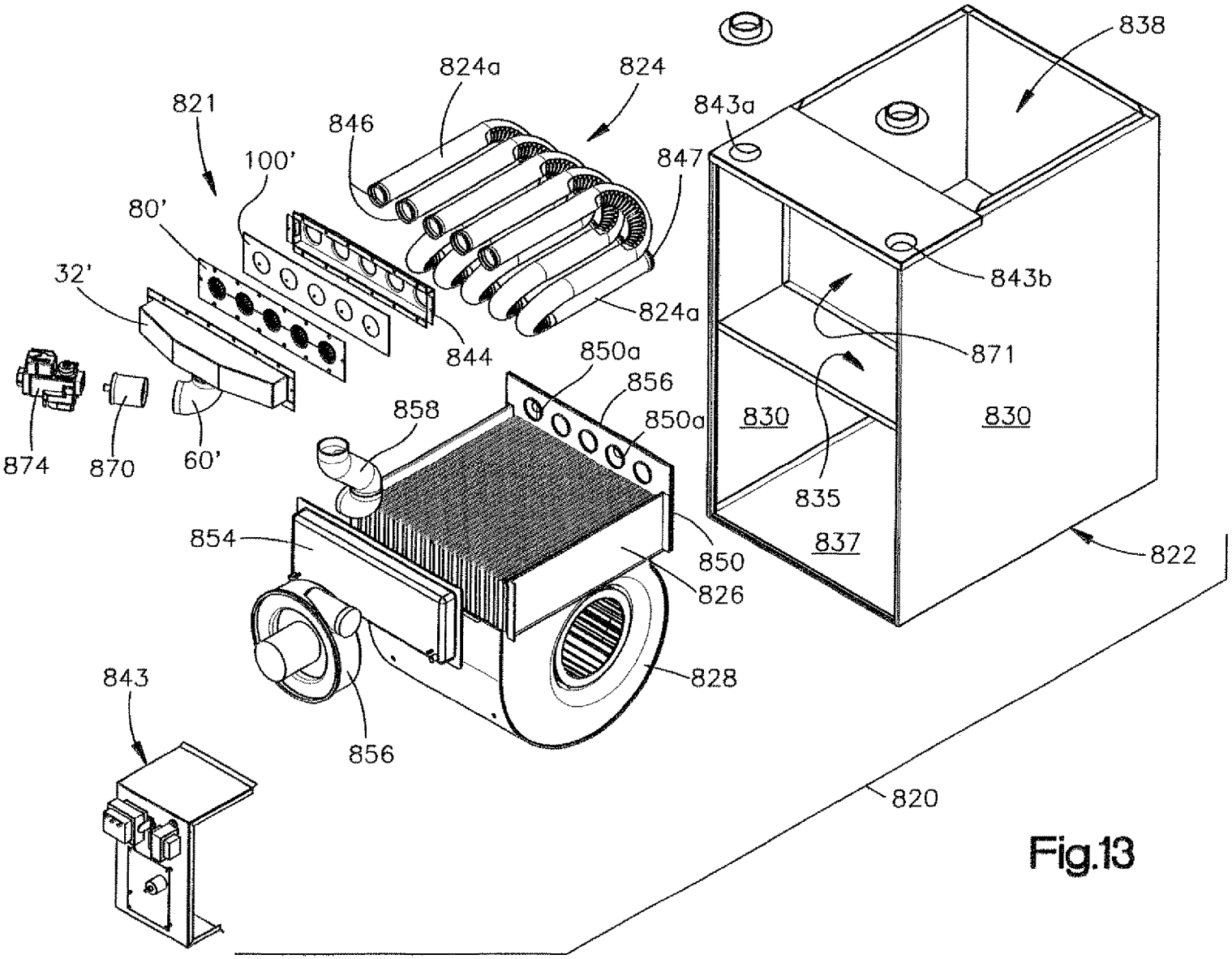
FIG. 13 is an exploded view of the furnace shown in FIG. 12A.

FIGS. 12A-13 illustrate a furnace 820 constructed in accordance with a preferred embodiment of the invention and which includes an embodiment of the previously described low $NO_x$ burner. Referring also to FIG. 13, the furnace 820 includes a furnace cabinet that houses and supports a burner assembly 821 constructed in accordance with a preferred embodiment of the invention, along with peripheral components, including heat exchangers, blowers, etc. In particular, the furnace 820 includes a furnace cabinet 822, a primary heat exchanger 824 that comprises a plurality of serpentine tubes 824*a*, a secondary, condensing heat exchanger 826, and a circulating air blower 828. Alternatively, the primary heat exchanger 824 may have a clamshell design known in the art. Components of the burner assembly 821 that are similar to the previously described components of the burner assemblies are given the same reference numeral with the added suffix "'".

Figure 14:
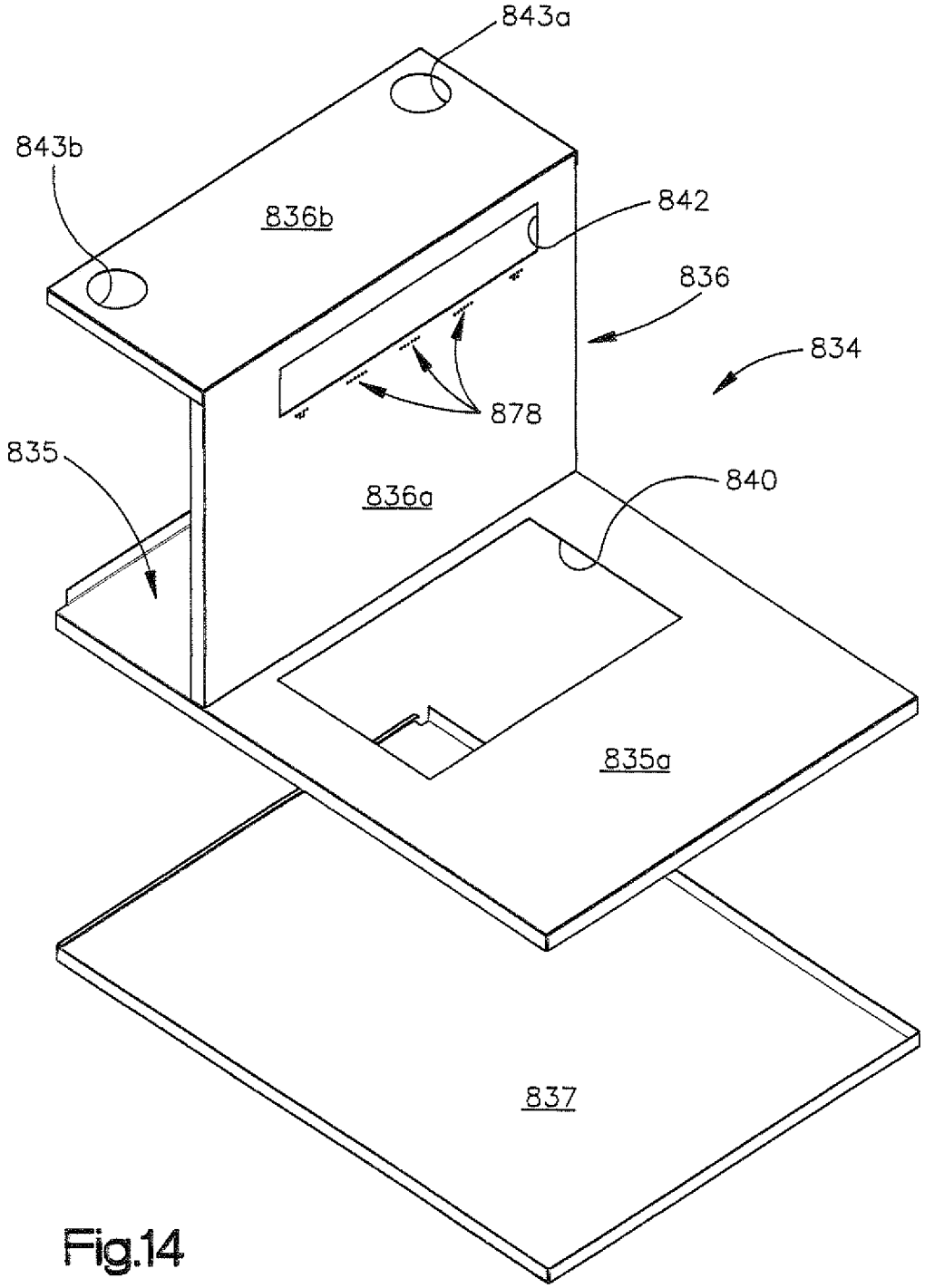
FIG. 14 is an isometric view of cabinet portions of the furnace shown in FIG. 12A.

Referring also to FIG. 14, the furnace cabinet includes a pair of vertical side panels 830 and a vertical rear panel 832. An intermediate plate assembly 834 is supported between the side panels 830 and the rear panel 832 and includes a blower deck plate 835 and an inverted L-shaped support plate 836. A vertical section 836*a* of the L-shaped support plate 836 forms a vest panel which, as will be explained, supports the burner 821 of the present invention. A horizontal segment 835*a* of the blower deck plate 835 and portions of the side panel 830 and rear panel 832 define a heat exchange chamber 838 (best shown in FIG. 13). The furnace 820 also includes a base 837 that cooperates with the horizontal segment 835*a* and portions of the side panel 830 and rear panel 832 to define a blower chamber for receiving the blower 828.

The secondary heat exchanger 826 (FIG. 13) sits atop and is supported by the deck plate segment 835*a* and overlies a rectangular opening 840. The blower 828 is supported below the deck plate 835 and includes a rectangular exit (not shown) aligned with the deck plate opening 840. Air discharged by the blower 828 enters the heat exchange chamber 838 through the opening 840. A control panel 843 is attached to the blower 828 and/or the blower deck plate 835 and mounts conventional controls for the blower 828 and burner assembly 821.

Figure 15:
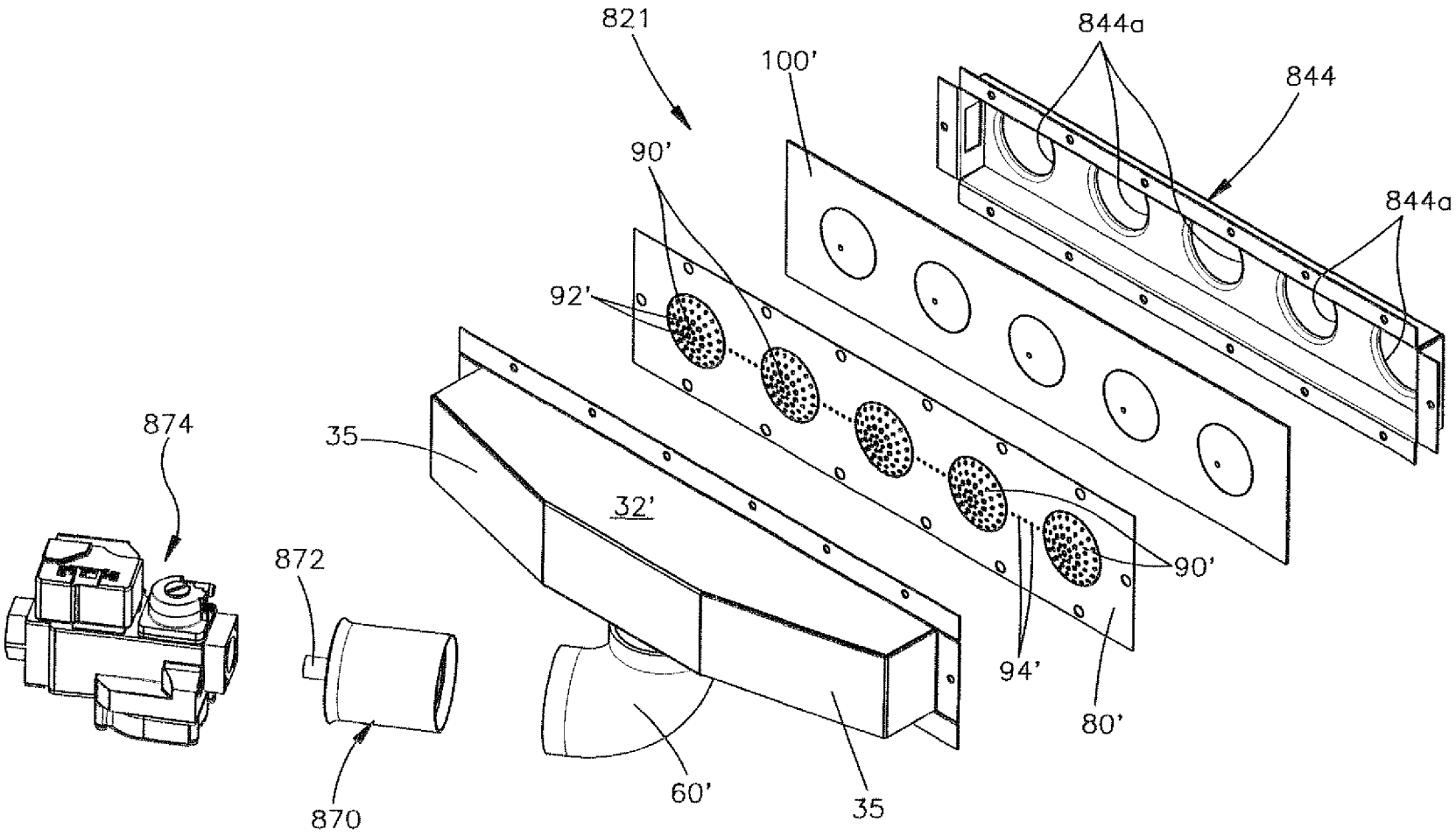
FIG. 15 is an exploded view of a burner assembly constructed in accordance with a preferred embodiment of the invention also showing peripheral components.

The burner assembly 821 of the present invention is attached to the vest panel 836*a* and is received in a rectangular opening 842 (FIG. 14) defined in the vest panel 836*a* of the plate 836. In particular, the burner body 32' is shaped and sized to conform to the rectangular opening 842 in the vest panel 836*a*. The burner body 32' includes tapered end sections 35 which operate to provide a more even flow of gas/air mixture to the distributor 80' (FIG. 15). The burner body 32' is suitably attached to the exterior side of the vest panel 836*a* and includes a fuel/air inlet 60'. The distributor 80' that defines the perforated portions 90' is clamped between the body 32' and the exterior of the vest panel 836*a*. A combustion chamber defining cover 844 is attached to the interior side of the vest panel 836*a* in alignment with the burner body 32'. The component 100' defining the burner surface (which may be the previously disclosed fiber mesh burner surface 100 or 600) is supported between the distributor 80' and the interior of the combustion chamber cover 844. The component 100' may be formed by, for example, sintering, weaving and/or knitting techniques.

The combustion chamber cover 844 includes a plurality of openings 844*a* each aligned with one of the burner portions 90' defined in the distributor 80'. The openings 844*a* each receive an associated inlet side 846 of an associated heat exchange section 824*a* (FIG. 13). It should be apparent that the portions 90' are therefore aligned with associated heat exchange sections 824*a*. The inlet sides 846 of the heat exchange sections 824*a* may be attached to the combustion chamber cover 844 by means of a known swaging process. The flame of each portion 90' extends through the associated opening 844*a* of the cover 844 and into the inlet side 846 of the associated heat exchange section 824*a*. The flames are tailored such that the tip of each flame terminates at or adjacent to the inlet side 846 of each section 824*a*, i.e., the flames may barely extend into the interior of each tube. Although 12B illustrates that the inlet sides 846 of the heat exchange sections 824*a* are substantially flush with or abut the combustion chamber cover 844, it will be appreciated that the inlet sides may alternatively extend into the combustion chamber cover or may be spaced from the combustion chamber cover (not shown).

As best seen in FIG. 13, discharge ends 847 of each heat exchange section 824*a* are connected (as by swaging) to an intermediate collector box 850 having associated ports 850*a*. The intermediate collector box 850 receives the hot exhaust gasses from the heat exchange sections 824*a* and causes the exhaust gas to pass through the secondary heat exchanger 826. After passing through the secondary heat exchanger 826, the exhaust gasses are received and collected in a collector chamber 854 which communicates with an induced draft blower 856. The exhaust gasses are drawn out by the induced draft blower 856 and are discharged to an outlet conduit 858. The exhaust is then conventionally discharged to another outlet located outside the heated space or home.

FIG. 15 is an exploded view of one embodiment of the burner assembly 821. The housing or body 32' includes the inlet conduit 60' which, in the illustrated embodiment, is formed as a 90° elbow and delivers a fuel/air mixture to the burner assembly 821. As seen in FIG. 15, the inlet elbow 60' is connected to a fuel/air mixer 870 which, as will be explained, includes a gas tube 872 (FIG. 17) that receives gas from a conventional gas valve 874. It should be noted that the gas valve 874 and the mixer 870 are all located within an enclosed furnace compartment 871 (see FIG. 12A) that is generally referred to as the vestibule or vestibule chamber. The vestibule 871 is at least partially defined by portions of the side panels 830 (FIG. 12A), the deck plate 835, the horizontal and vertical sections 836*b*, 836*a* of the inverted L-shaped support plate 836 and a removable cover (not shown) that closes the vestibule. The mixer 870 also receives ambient air (in the vestibule 871), mixes the air with the gas delivered via the gas conduit 872, and delivers the air/fuel mixture to the inlet conduit 60'.

Figure 16:
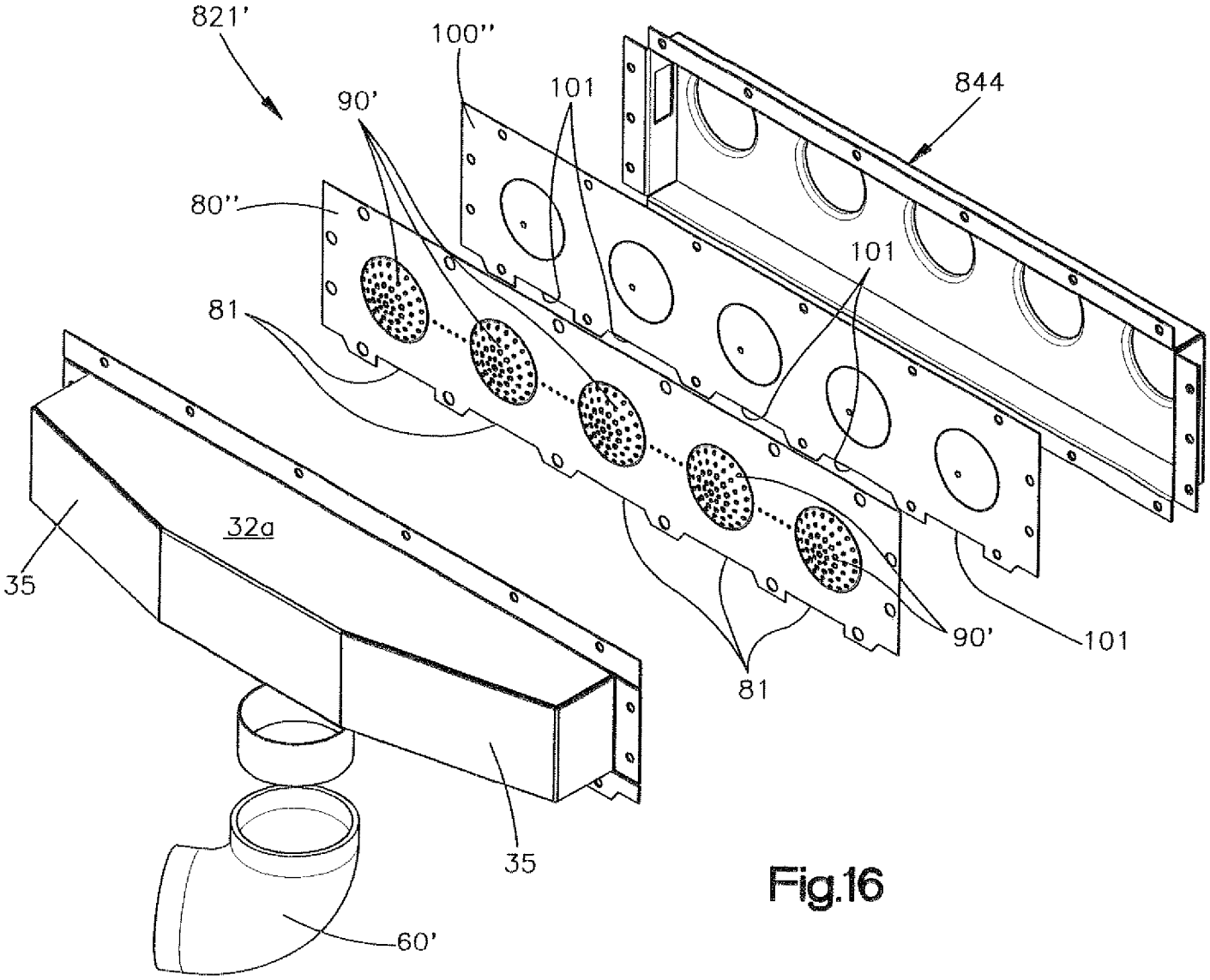
FIG. 16 is an exploded view of a burner assembly constructed in accordance with another embodiment of the invention.

FIG. 16 illustrates an alternate embodiment of a burner assembly 821' that provides a means for relieving pulses that occur during burner assembly operation or start up. In particular, the distributor 80" and burner surface component 100" each include relief sections 81, 101, respectively, which are aligned with associated relief ports 878 defined in the vest panel 836*a* (shown in FIG. 14). These relief sections 81, 101 communicate with the ambient, i.e., the exterior side of the vest panel 836*a* or vestibule 871. With this configuration, should a pressure pulse occur during operation or startup of the burner assembly 821', it is relieved by allowing pressure waves to escape from the combustion chamber defined by the cover 844 to the ambient (or vestibule 871). The pressure relieving port 878 are only formed in the vest panel 836*a* when the burner assembly 821' shown in FIG. 16 is used. Alternately, the ports 878 may be formed in the vest panel 836 for both burner assembly 821, 821' configurations but are blocked when the burner assembly configuration of FIG. 15 is being used. Furthermore, it is believed that the sections 81, 101 and ports 878 may allow secondary air to flow into the combustion chamber during operation of the burner assemblies 821, 821'. In any case, the flame of each portion 90' extends through the associated opening 844*a* in the cover 844 and into the inlet side 846 of the associated heat exchange section 824*a*. The flames are tailored such that the tip of each flame terminates at or adjacent to the inlet side 846 of each section 824*a*, i.e., the flames may barely extend into the interior of each section.

Referring to FIG. 12A, the furnace cabinet 822 includes conduit ports 843*a*, 843*b*. The conduit port 843*a* receives a combustion air conduit (not shown) that provides a source of combustion air which is delivered to the vestibule 871 and, thus, is delivered to the mixer 870. The port 843*b* receives an exhaust conduit (not shown) through which the products of combustion are exhausted to the outside. Generally, the conduits connected to these ports communicate with the ambient outside the home or building being heated.

Figure 17:
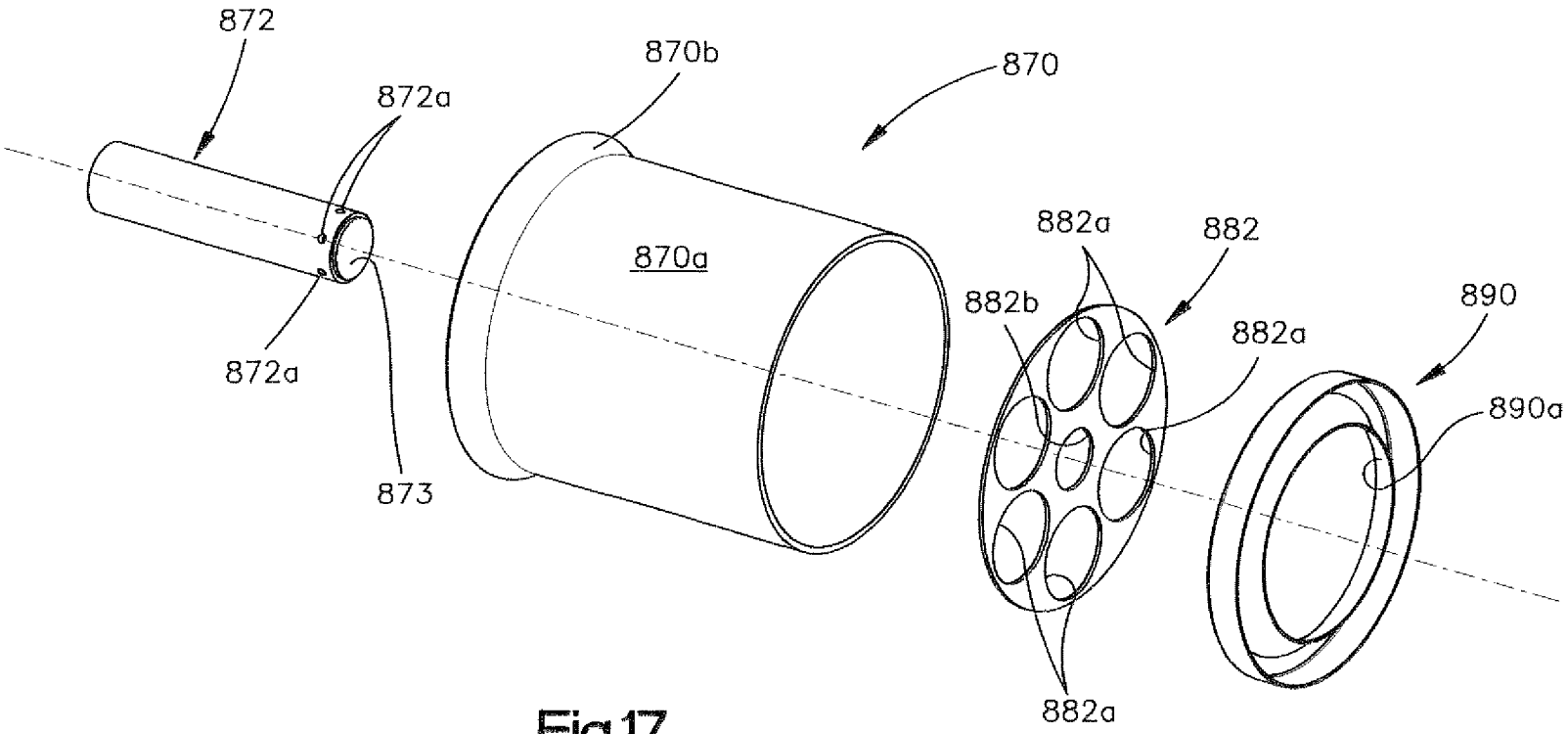
FIG. 17 is an exploded view of a gas/air mixer constructed in accordance with a preferred embodiment of the invention.

FIG. 17 illustrates the construction of the mixer 870 shown in FIG. 13. The mixer 870 includes a cylindrical body 870*a*, which mounts a circular baffle plate 882 having a plurality of air openings 882*a*, preferably equally distributed about a center hole 882*b*. The center hole 882*b* receives the gas inlet tube 872 which includes a plurality of radial openings 872*a*. Air is received through the bell-shaped inlet opening 870*b* of the cylindrical housing 870*a*, travels through the openings 882*a* defined in the baffle plate 882, and is mixed with gas that is discharged through both an outlet end 873 of the gas tube 872 and the radial openings 872*a* of the gas tube 872. An annular stamped venturi ring 890 is mounted to the discharge side of the cylindrical body 870*a* and defines a converging or tapered section which, in turn, defines an outlet opening 890*a* that is suitably connected to the burner inlet conduit 60'. It is believed that this configuration produces a venturi effect for the mixer 870. One example of a mixer 870 that can be used in the present invention is disclosed in U.S. Pat. No. 5,839,891, the subject matter of which is incorporated herein in its entirety.

As best seen in FIGS. 12B and 14 and according to a feature of the invention, the blower opening 840 in the blower deck plate 835 is located near the inlet side 846 of the heat exchange sections 824*a* and, thus, air to be heated is discharged near the burner side of the heat exchange chamber 838, i.e., near the vest panel 836*a*. In conventional furnaces, the flames extend deep into the heat exchange tubes and therefore the blower—and associated blower opening—is located further down the length of the tubes from the burner side. Since the flames from the burner assembly 821, 821', 821" terminate at or adjacent to the openings in the heat exchange sections 824*a* the blower opening 840 and blower 828 can be aligned with the inlets to the heat exchange sections on a side of the vest panel 836 opposite to the burner assembly, i.e., within the heat exchange chamber 838. Air from the blower 828 therefore washes over the heat exchange sections 824*a* where the flames are the hottest.

This configuration is advantageous in that the vest panel 836 separates the majority of the burner assembly 821, 821', 821" within the vestibule 871 from the primary heat exchanger 824 within the heat exchange chamber 838 (see FIG. 13). More specifically, the entire burner assembly 821, 821', 821" except for the cover 844 is positioned on the vestibule side of the vest panel 836. However, the cover 844—where the flames exit the burner assembly 821, 821', 821"—and the inlets to the heat exchange sections 824*a* are positioned on the heat exchange chamber side of the vest panel 836. Due to this configuration, the vest panel 836 reduces the exposure to heat by any electrical or mechanical components within the vestibule 871 as the flames terminate on the opposite side of the vest panel within the heat exchange chamber 838.

Furthermore, this configuration increases the volume of heated comfort air that can be produced during operation of the burner assembly. The termination of the flames at the openings to the heat exchange sections 824*a* increases the length and surface area of the primary heat exchanger 824 that can be utilized to transfer heat to the comfort air compared to other burners, e.g., inshot burners, in similarly-sized furnaces. In other words, compared to inshot burners in which the heat generated by the flames begins at a position down the length of the heat exchanger tube, the flames from the burner of the present invention generate heat at the inlet ends of the heat exchanger tubes, thereby maximizing the effective length of the tubes that can be heated for producing comfort air.

Figure 18A:
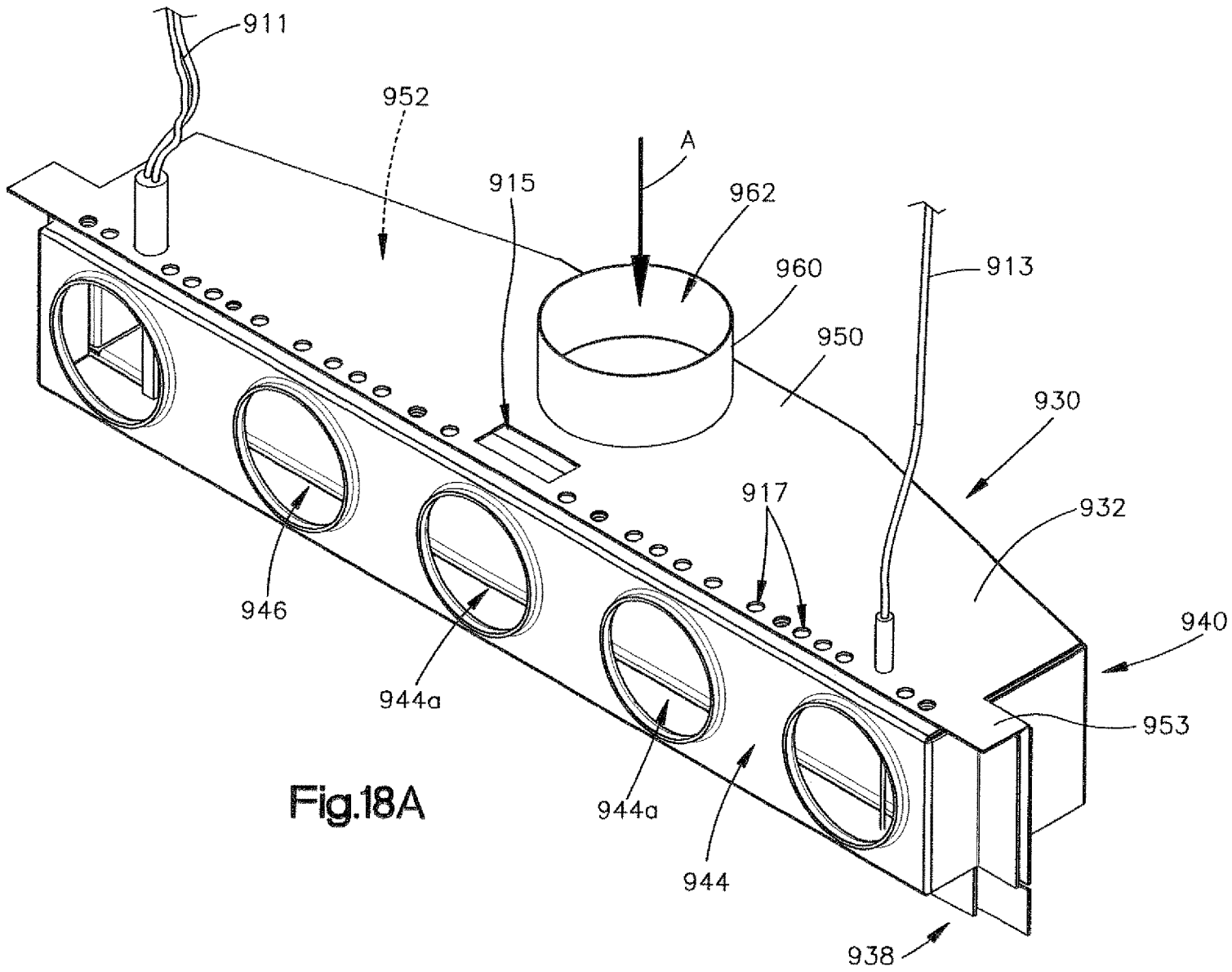
FIGS. 18A-18B are isometric views of an alternative cabinet portion and burner in accordance with an aspect of the invention.
Figure 18B:
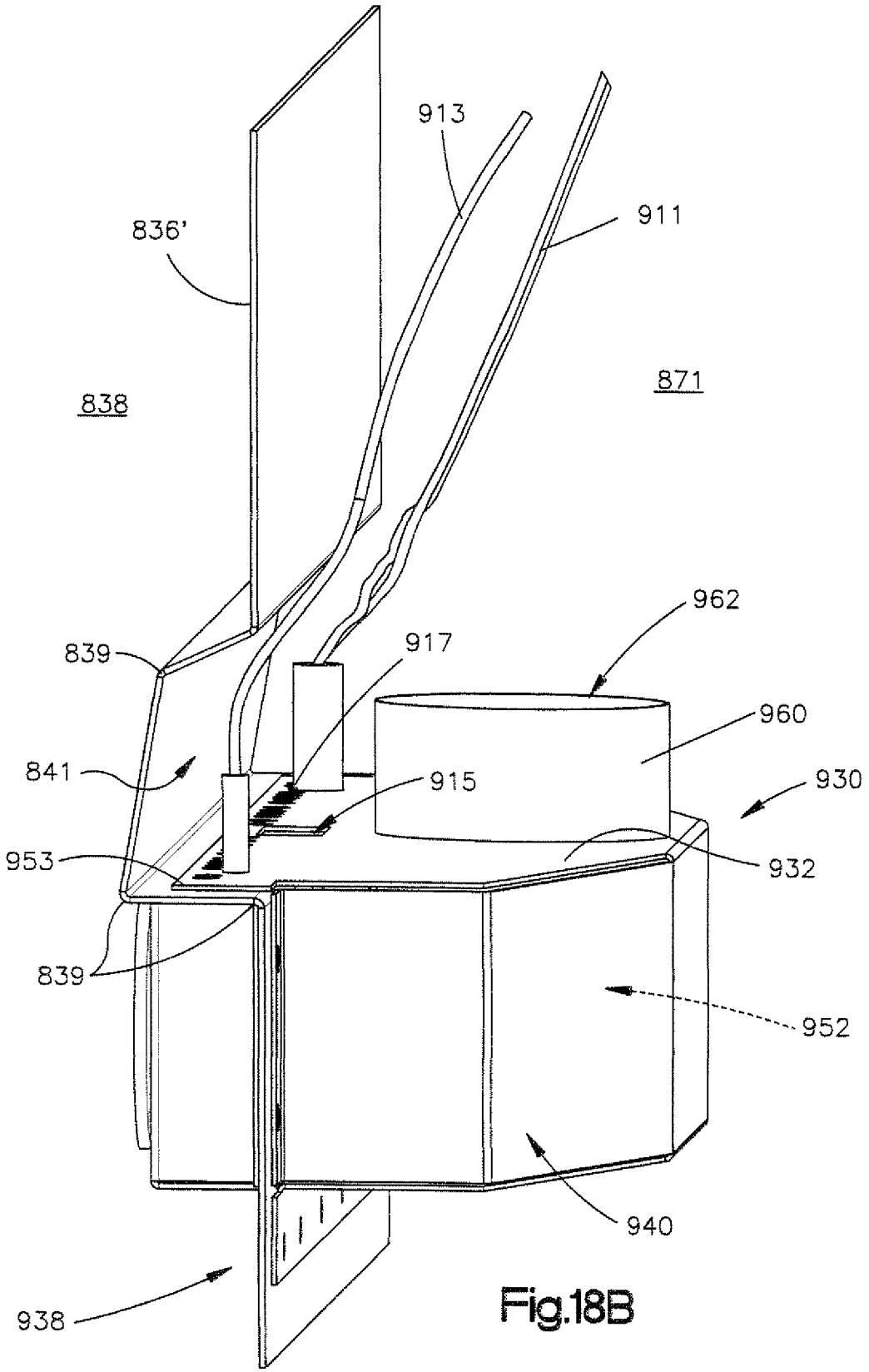
Figure 19:
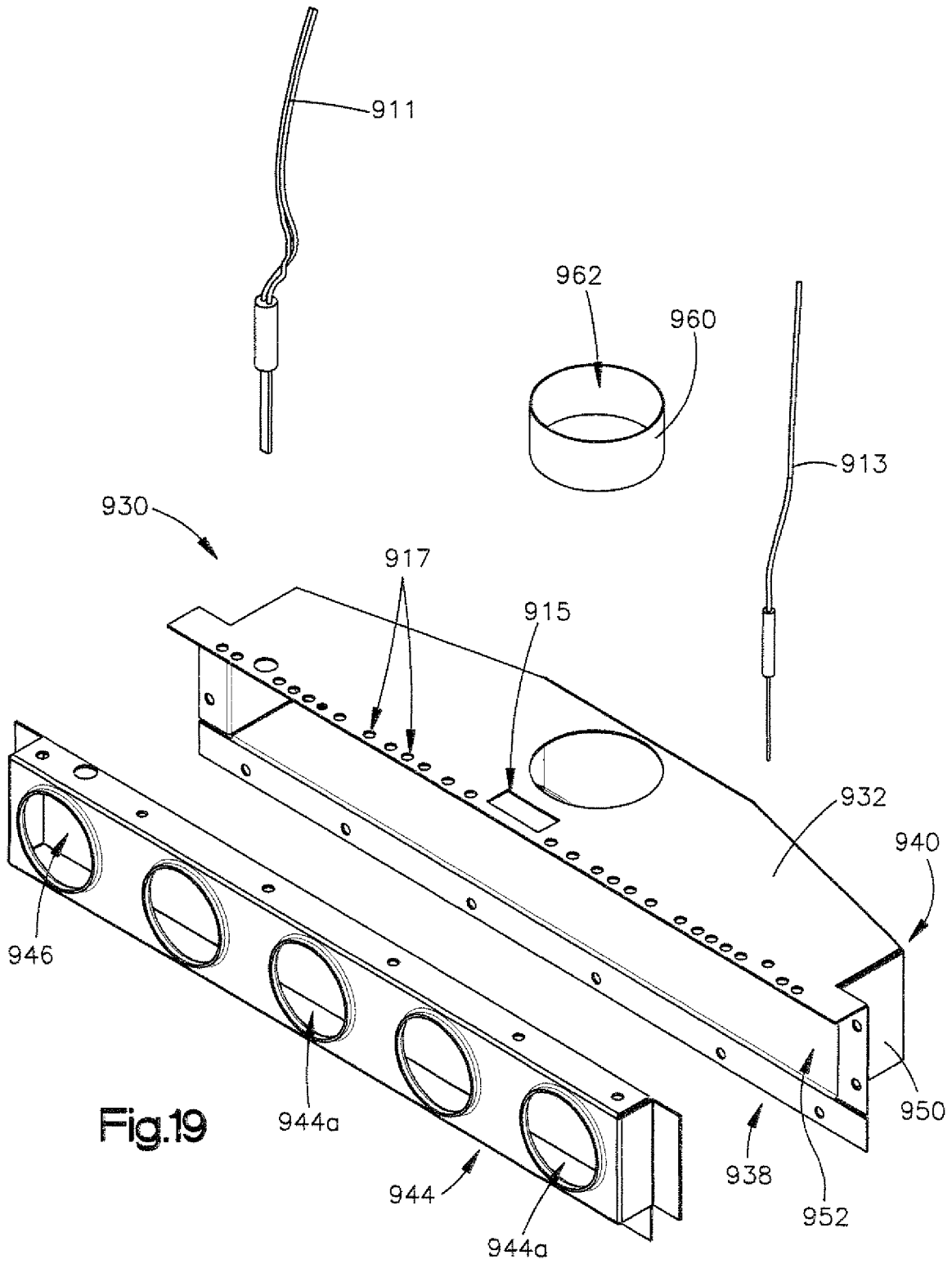
FIG. 19 is an exploded view of the burner of FIG. 18A.

FIGS. 18A-19 illustrate portions of a burner 930 in accordance with another aspect of the present invention—the distributor and fiber mesh are omitted for brevity and clarity. In FIGS. 18A-19, features that are similar to those in FIGS. 1-3 have a reference numeral that is 900 greater than the reference numerals in FIGS. 1-3. In FIGS. 18A-19, the burner 930 is configured such that the igniter 911 and flame sensor 913 are positioned outside the heat exchanger compartment 838 and within the vestibule 871. More specifically, the burner 930 includes a body 932 having a substantially trapezoidal sidewall 950 that defines an interior chamber 952. The sidewall 950 includes an extension 953 that extends along the front side 938 of the body 932. The vest panel 836' includes a series of bends 839 that form a notch which defines a passage 841 extending along and above the extension 953 for receiving the extension. The bends 839 position the extension 953 outside of the heat exchanger compartment 838 and the passage 841 is sized to allow the igniter 911 and flame sensor 913 to be inserted through the extension 953 into the interior 952 of the body 932. A viewing window 915 formed in the extension 953 allows for visual inspection of the interior chamber 952. Furthermore, a series of pressure relief sections constituting openings 917 may be formed along the extension 953 for mitigating pulsing and resonance within the interior chamber 952. It is believed that these openings 917 may allow secondary air to flow into the combustion chamber during operation of the burner assembly 930.

The combustion chamber cover 944 is attached to the interior or heat exchanger compartment 838 side of the vest panel 836*a'*. The combustion chamber cover 944 includes an interior space 946 and a plurality of openings 944*a* each aligned with one of the burner portions (not shown) defined in the distributor (not shown). The openings 944*a* each receive an associated inlet side 846 of an associated heat exchange section 824*a* (FIG. 13) to align the burner portions with associated heat exchange sections 824*a*. The inlet sides 846 of the heat exchange sections 824*a* may be attached to the combustion chamber cover 944 by means of a known swaging process. The flame of each burner portion extends through the associated opening 944*a* of the cover 944 and into the inlet side 846 of the associated heat exchange section 824*a*. Both the igniter 911 and the flame sensor 913 may extend through the combustion chamber cover 944 to the interior space 946 within the heat exchange chamber 838.

Figure 20A:
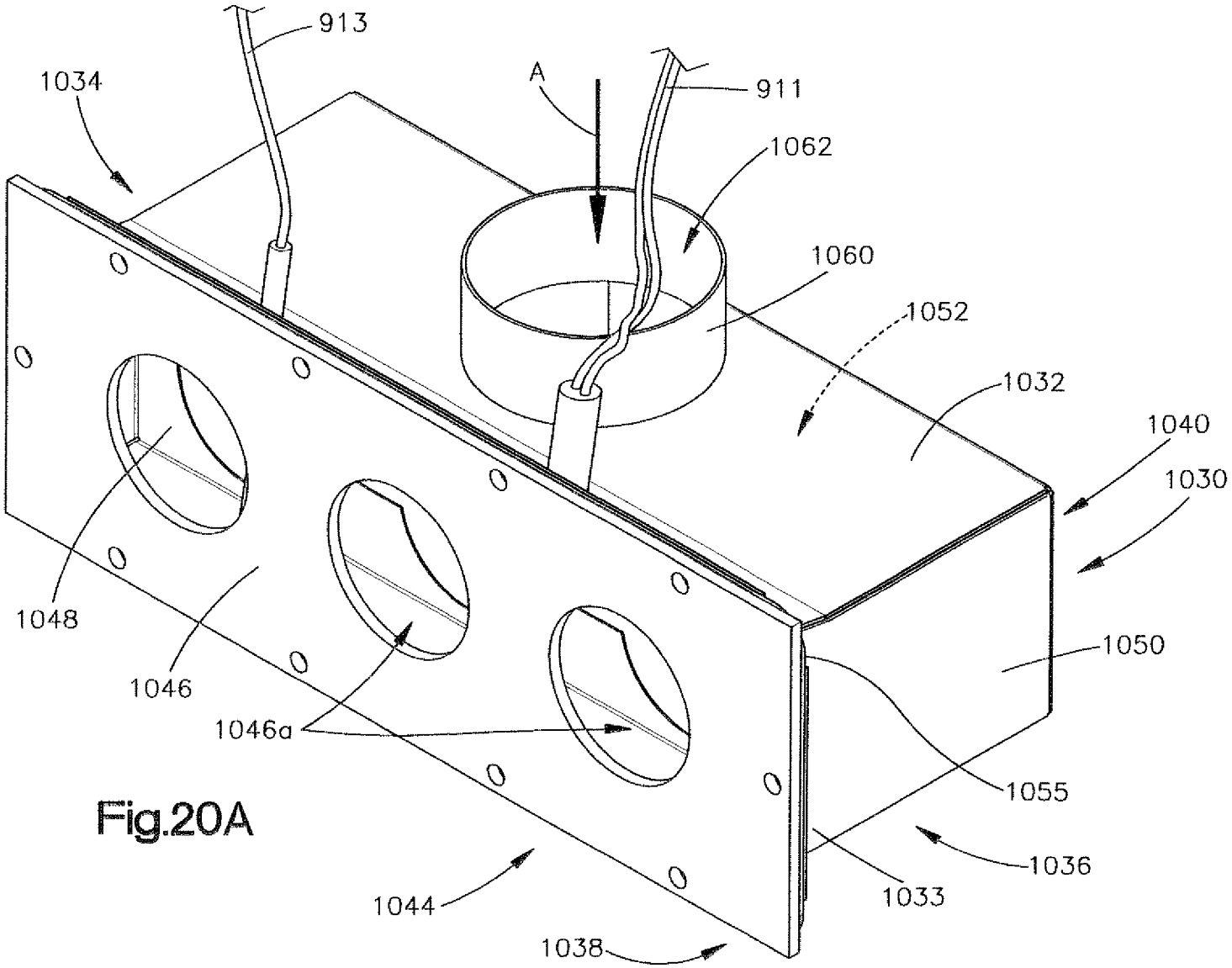
FIG. 20A is an isometric view of a burner in accordance another aspect of the invention.
Figure 20B:
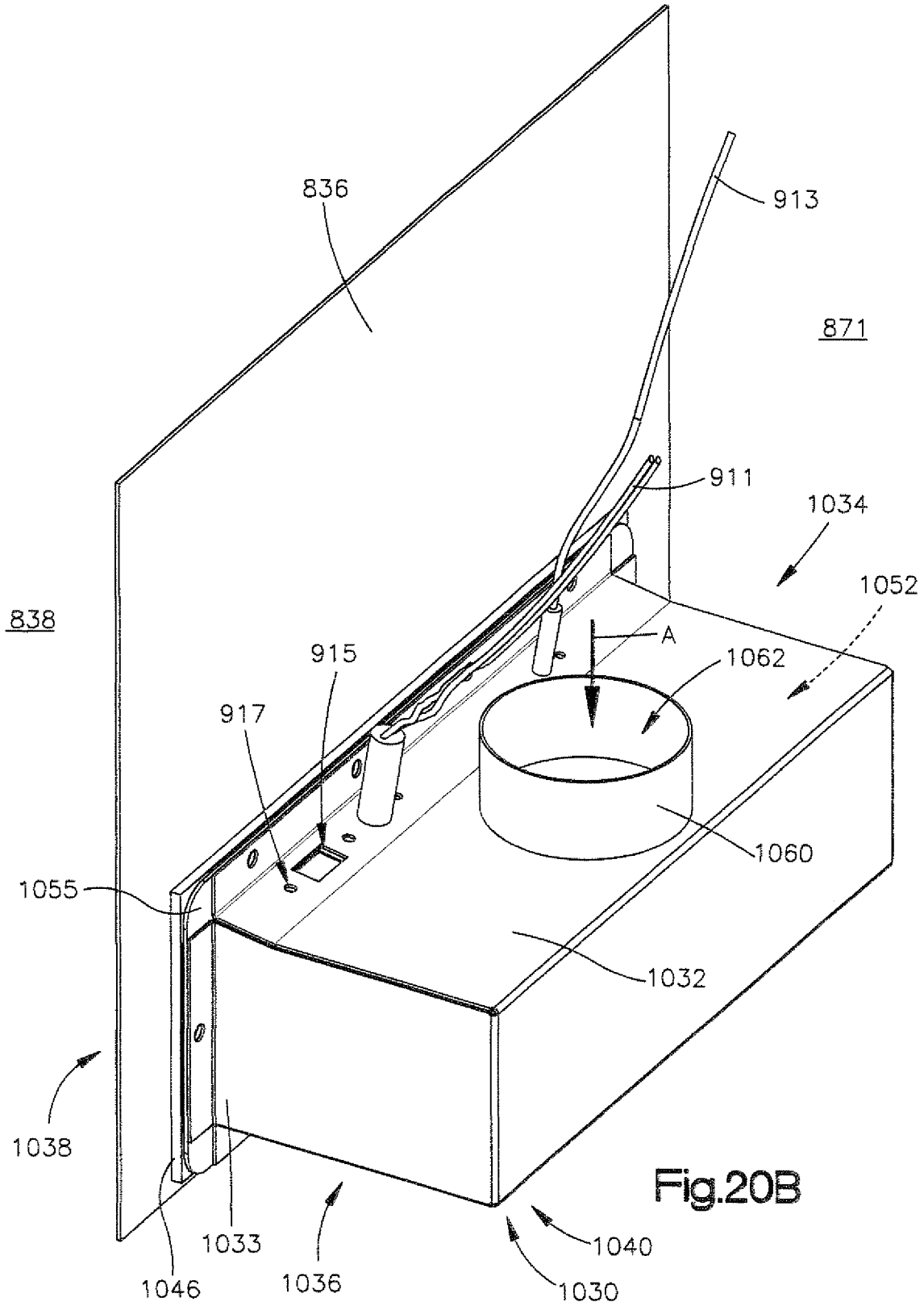
FIG. 20B is a side view of FIG. 20A with the burner assembly secured to a cabinet portion.
Figure 21:
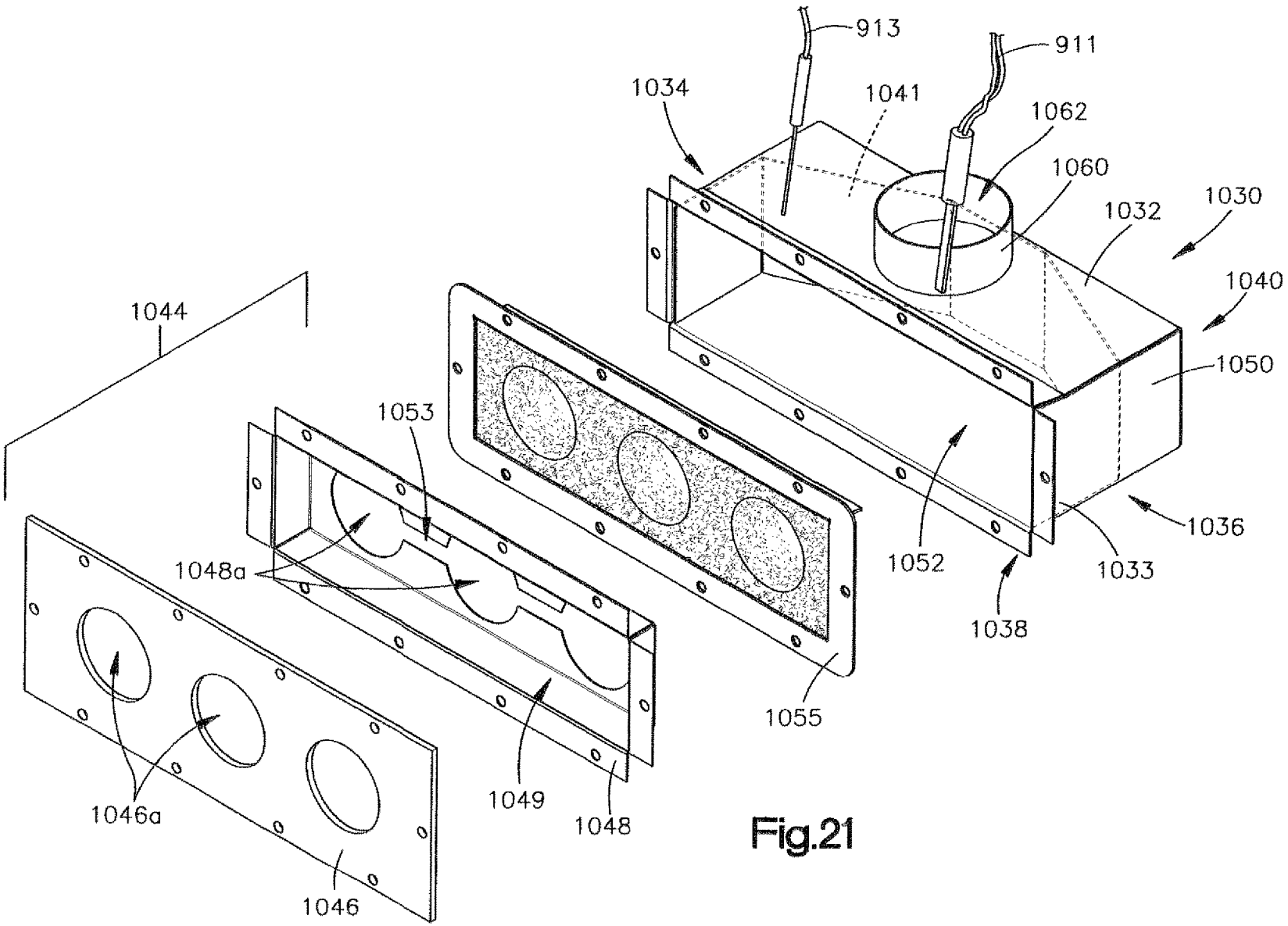
FIG. 21 is an exploded view of the burner of FIG. 20A.

FIGS. 20A-21 illustrate portions of a burner 1030 constructed in accordance with another aspect of the present invention—the distributor is omitted for brevity and clarity. In FIGS. 20A-21, features that are similar to those in FIGS.

1-3 have a reference numeral that is 1000 greater than the reference numerals in FIGS. 1-3. In FIGS. 20A-21, the burner 1030 is configured such that the combustion chamber for producing the flames $F_1$-$F_N$ is located within the body 1032 on the vestibule 871 side of the vest panel 836. More specifically, the body 1032 has a substantially rectangular sidewall 1050 that defines an interior chamber 1052. A baffle 1041 is provided in the interior chamber 1052 to direct the incoming pre-mix mixture A to particular locations within the body 1032, e.g., toward the first and second ends 1034, 1036 of the body. In one example, the baffle 1041 has a trapezoidal shape.

The sidewall 1050 includes a portion 1033 that extends from the first side 1034 to the second side 1036 and tapers outwardly in a direction towards the front side 1038 of the body 1032. The portion 1033 terminates at the vest panel 836 within the vestibule 871. The igniter 911 and flame sensor 913 extend into the portion 1033. The portion 1033 is located entirely within the vestibule 871 and acts as the combustion chamber for the burner assembly 1030. Consequently, the combustion chamber for the burner assembly 1030 is located entirely within the vestibule 871. A viewing window 915 formed in the portion 1033 allows for visual inspection of the combustion chamber. Furthermore, a series of pressure relief openings 917 may be formed along the portion 1033 for mitigating pulsing and resonance within the interior chamber 952.

The cover 1044 (FIG. 21) helps to secure the burner assembly 1030 to the vest panel 836. The cover 1044 includes a first or front portion 1046 and a second or rear portion 1048. The rear portion 1048 helps to secure the contoured wire mesh 1055 to the body 1032 in order to close the interior space 1052. The rear portion 1048 includes a plurality of openings 1048*a* each aligned with an associated inlet side 846 of an associated heat exchange section 824*a* (not shown). A plurality of carryover openings 1053 fluidly connect the openings 1048*a* to one another such that a flame initiated within one of the openings 1048*a* is carried over and reproduced in the remaining openings 1048*a*. The front portion 1046 is secured to the rear portion 1048 to define a combustion chamber 1049 therebetween. The front portion 1046 also includes a plurality of openings 1046*a* that correspond with the openings 1048*a* in the rear portion 1048. The front portion 1046 is secured to the vest panel 1046 (FIG. 20B) to place the cover 1044 and burner assembly 1030 within the vestibule 871, thereby placing the combustion chamber 1049 within the vestibule.

The present invention has been described in connection with a condensing type furnace. It should be noted that the burner of the present invention can be used in a non-condensing type furnace. Typically, in this type of furnace, the secondary heat exchanger 826 would be eliminated. In addition, the burner assembly 821 would be mounted in alignment with a horizontal slot (not shown) that would be located in a lower section of the vest panel 836 nearer the horizontal segment 835*a*. In this configuration, the sections 824*a* would have their inlet sides 846 join the combustion chamber cover 844 near the bottom of the vest panel 836. The upper or discharge ends 847 of the heat exchange sections 824*a* would be connected to a collection chamber located at the top of the vest panel 836 and in fluid communication with the induced draft blower 856.

The burner assembly of the present invention may advantageously be configured for use in high-efficiency residential furnaces. More specifically, by using both the first and secondary heat exchangers 824, 826 the condensing furnace 820 is capable of about 90% or greater efficiency. Using only the primary heat exchanger 824 produces a non-condensing furnace 820 capable of about 80-83% efficiency. The preferred embodiments of the invention have been illustrated and described in detail. However, the present invention is not to be considered limited to the precise construction disclosed. Various adaptations, modifications and uses of the invention may occur to those skilled in the art to which the invention relates and the intention is to cover hereby all such adaptations, modifications, and uses which fall within the spirit or scope of the appended claims.

Having described the invention, the following is claimed:

1. A burner for use with an igniter for firing a flame into a heat-exchanger comprising:
   - a body defining an interior chamber;
   - a first opening in the body for receiving a pre-mixed mixture of air and fuel;
   - a second opening in the body in fluid communication with the first opening;
   - a distributor connected to the body and covering the second opening, the distributor comprising:
     - a first portion; and
     - a plurality of curved second portions provided on the first portion, each second portion including a plurality of first perforations in fluid communication with the first opening in the body, wherein the first perforations of one second portion are positioned adjacent to the igniter such that ignition of the pre-mixed mixture flowing through the first perforations results in a flame through the second portion; and
   - a metal fiber mesh burner surface secured to and overlying only a downstream side of the distributor for retaining the flame thereon while an upstream side of the distributor is exposed to the pre-mixed mixture flowing from the body, wherein the mesh burner surface defines a burner surface where combustion of the pre-mixed mixture occurs, the mesh burner surface including a curved portion which at least partially conforms to one of the curved second portions in the distributor.

2. The burner of claim 1, wherein each second portion is concave.

3. The burner of claim 1, wherein each second portion includes a concave component and a convex component.

4. The burner of claim 1, wherein the first perforations of each second portion increase in size in a direction towards the center of each second portion.

5. The burner of claim 1, wherein the second portions are fluidly connected to one another by a plurality of second perforations formed in the first portion such that ignition of the pre-mixed mixture flowing through the first perforations of one second portion results in a flame at each of the second portions.

6. The burner of claim 5, wherein the second perforations surround each second portion.

7. The burner of claim 5, wherein the second portions are arranged in a triangular pattern.

8. The burner of claim 1, wherein the distributor is formed from one of metal, metal screen, and expanded metal.

9. The burner of claim 1 further comprising at least one baffle positioned within the interior chamber for directing the pre-mixed mixture to the each second portion.

10. The burner of claim 1, wherein the sidewall of the body tapers outwardly in a direction extending away from the second opening for reducing pulsing and resonance within the interior chamber.

11. The burner of claim 1, wherein a plurality of relief openings are provided in the sidewall for reducing pulsing and resonance within the interior chamber.

12. The burner of claim 1, wherein a viewing window is provided in the sidewall for viewing the interior chamber.

13. The burner of claim 1 further comprising a cover secured to the distributor and defining a combustion chamber.

14. The burner of claim 13 further comprising a flame proving sensor extending through the body into the combustion chamber.

15. The burner of claim 1, wherein the distributor includes relief portions for relieving pressure from the combustion chamber.

16. The burner of claim 1, wherein the body includes a tapered portion that defines the opening and forms a combustion chamber within the body, the igniter extending through the tapered portion into the combustion chamber.

17. The burner of claim 1, wherein the curved second portions are spaced entirely from one another along the first portion.

18. The burner of claim 17, wherein the planar first portion encircles each individual second portion.

19. The burner of claim 1, wherein each of the curved second portions has a circular cross-section extending within a plane of the first portion.

20. The burner of claim 2, wherein the first portion is planar and the concave second portions extend directly from the first portion to a location upstream of the first portion.

21. The burner of claim 2, wherein the first portion is planar and each of the second portions extends from the first portion to an axis located at the center of the second portion.

22. The burner of claim 1, wherein the first portion is planar and the second portions are hemispherical with a periphery connected directly to the first portion.

23. The burner of claim 1, wherein the mesh burner surface includes a planar portion that overlies the first portion of the distributor and curved portions that overlie the curved second portions of the distributor.

24. The burner of claim 23, wherein the mesh burner surface extends to both an upstream side and a downstream side of the first portion of the distributor.

25. The burner of claim 1, wherein both the curved portion of the mesh burner surface and the curved second portions of the distributor are concave.

* * * * *